US011414850B2

(12) United States Patent
Tone et al.

(10) Patent No.: US 11,414,850 B2
(45) Date of Patent: Aug. 16, 2022

(54) FLUSH TOILET

(71) Applicant: TOTO LTD., Kitakyushu (JP)

(72) Inventors: Yusuke Tone, Kitakyushu (JP); Shu Kashirajima, Kitakyushu (JP); Hideo Iwaki, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/178,014

(22) Filed: Feb. 17, 2021

(65) Prior Publication Data

US 2021/0262212 A1 Aug. 26, 2021

(30) Foreign Application Priority Data

Feb. 25, 2020 (JP) ..... JP2020-029309

(51) Int. Cl.
*E03D 5/01* (2006.01)
*E03D 1/012* (2006.01)

(52) U.S. Cl.
CPC ..... *E03D 5/01* (2013.01); *E03D 1/012* (2013.01); *E03D 2201/30* (2013.01)

(58) Field of Classification Search
CPC ..... E03D 5/01; E03D 1/012
See application file for complete search history.

(56) References Cited

U.S. PATENT DOCUMENTS

2009/0313750 A1 12/2009 Okubo et al.
2013/0291297 A1* 11/2013 Kitamura ..... E03D 5/10 4/422
2021/0108403 A1* 4/2021 Kato ..... E03D 9/005

FOREIGN PATENT DOCUMENTS

JP 8-311952 A 11/1996
JP 2009-2075 A 1/2009
JP 2009-30405 A 2/2009
JP 2014-114627 A 6/2014
JP 2016-180305 A 10/2016

OTHER PUBLICATIONS

Notice of Reasons for Refusal issued in Japanese Patent Application No. 2020-029309, dated Nov. 10, 2021.

* cited by examiner

*Primary Examiner* — Christine J Skubinna
(74) *Attorney, Agent, or Firm* — BakerHostetler

(57) ABSTRACT

A flush toilet includes a toilet main body and a tank device that supplies flush water to the toilet main body, where the tank device includes a storage tank provided behind the toilet main body and above a floor surface, and a water supply device that supplies the flush water to the storage tank, a capacity of an upper part located at a position higher than a middle height position that equally divides the storage tank into two in an up-down direction is greater than a capacity of a lower part located at a position lower than the middle height position, and the storage tank includes a plurality of upper surfaces with height differences, and a water passage port is provided in a manner penetrating a highest surface among the upper surfaces to allow the flush water supplied from the water supply device to flow into the storage tank.

6 Claims, 14 Drawing Sheets

FLUSH TOILET

CROSS REFERENCE TO RELATED APPLICATION

This application claims benefit of priority to Japanese Patent Application No. 2020-029309, filed Feb. 25, 2020, the entire content of which is incorporated herein by reference.

FIELD OF THE INVENTION

The present invention relates to a flush toilet, and more particularly, to a flush toilet for discharging waste by flushing the flush toilet with flush water.

BACKGROUND OF THE INVENTION

Conventionally, as flush toilets for flushing and discharging waste with flush water, those that perform toilet flushing by pressurizing flush water that is stored in a storage tank into a toilet main body with a pump are known, as disclosed in Patent Document 1 (Japanese Patent Laid-Open No. 2009-30405) and Patent Document 2 (Japanese Patent Laid-Open No. 2014-114627), for example.

The storage tank of such a conventional flush toilet is provided with a water supply part that allows water to be supplied into the storage tank. Furthermore, the water supply part is partitioned off from inside of the storage tank so as to prevent flush water in the storage tank from flowing backward.

However, with a conventional flush toilet as described above, in the case where a top surface of the storage tank is flat, if the storage tank is obliquely installed due to a manufacturing error of the toilet main body or an assembly error of the storage tank and the toilet main body, for example, there is a problem that air entrapment occurs on a tilted side.

Accordingly, there is a risk that the amount of flush water stored in the storage tank is reduced by the volume of trapped air or is varied, for example.

Moreover, when air is trapped in the storage tank, there is a problem that the trapped air is may be captured in the flush water at the time of water supply to the storage tank as the flush water in the storage tank rises, and abnormal noise may be generated.

Therefore, there is conventionally a demand to suppress tilting of the storage tank to prevent occurrence of air entrapment in the storage tank.

The present invention has been made to solve the problems of the related arts and to cope with the conventional demand, and an object thereof is to provide a flush toilet according to which air entrapment due to tilting of a storage tank may be prevented to allow a greater amount of flush water to be stored in the storage tank, and occurrence of abnormal noise due to air entrapment may be prevented.

SUMMARY OF THE INVENTION

To solve the problems described above, the present invention is a flush toilet including: a toilet main body including a bowl configured to receive waste, and a discharge trap configured to discharge the waste in the bowl; and a tank device configured to supply the flush water to the toilet main body, where the tank device includes: a storage tank configured to store the flush water to be supplied to the toilet main body, the storage tank being provided behind the toilet main body and above a floor surface, a water supply device configured to supply the flush water to the storage tank, and a pump configured to pressurize and feed the flush water in the storage tank to the toilet main body, the storage tank includes an upper part and a lower part, and the upper part is located at a position higher than a middle height position that equally divides the storage tank into two in an up-down direction, and the lower part is located at a position lower than the middle height position, and a capacity of the upper part is greater than a capacity of the lower part, and the storage tank includes a plurality of upper surfaces with height differences, and a water passage port is provided in a manner penetrating a highest surface among the upper surfaces to allow the flush water that is supplied from the water supply device to flow into the storage tank.

According to the flush toilet described above, when the storage tank including the upper surface with a height difference is tilted, because the capacity of the upper part that is located at a position higher than the middle height position that equally divides the storage tank into two in the up-down direction is greater than the capacity of the lower part that is located at a position lower than the middle height position of the storage tank, air tends to be trapped inside the upper part of the storage tank.

However, in the present invention, even when air is trapped inside the storage tank at the time of water supply from the water supply device to the storage tank, the water passage port provided in the highest surface among the upper surfaces of the storage tank may function as an air vent that facilitates escape of air that is trapped beforehand.

Accordingly, even when the capacity of the upper part that is located at a position higher than the middle height position that equally divides the storage tank into two in the up-down direction is greater than the capacity of the lower part that is located at a position lower than the middle height position of the storage tank, the amount of flush water that is supplied from the water supply device and stored in the storage tank may be prevented from being reduced or varied due to the trapped air in the storage tank. A greater amount of flush water may thus be stored in the storage tank.

Furthermore, when water is supplied from the water supply device to the storage tank and the water level inside the storage tank rises, because air trapped in the storage tank can easily escape from the water passage port beforehand, occurrence of abnormal noise due to trapped air (for example, abnormal noise that is generated at the time of trapped air in the storage tank being captured in the water being supplied, abnormal noise that is generated at the time of trapped air escaping from the water passage port (deaeration sound), and the like) may be prevented.

In the present invention, preferably, the upper surface of the storage tank is formed such that the upper surface becomes lower from a surface where the water passage port is formed toward an outer periphery in a continuous or stepwise manner.

According to the flush toilet described above, because the upper surface of the storage tank is formed such that the upper surface becomes lower from a surface where the water passage port is formed toward an outer periphery in a continuous or stepwise manner, even if the storage tank is tilted, air inside the storage tank may be guided to the water passage port of the storage tank along the upper surface of the storage tank that becomes lower in a continuous or stepwise manner.

Accordingly, air entrapment in the storage tank may be reliably prevented.

In the present invention, preferably, the toilet main body is made of ceramics, and the storage tank includes fixing portions that are fixable to the toilet main body.

According to the flush toilet described above, a dimensional error easily occurs for the toilet main body made of ceramics at the time of manufacture, and the greater the dimensional error of the toilet main body, the greater the possibility of the storage tank being greatly tilted when the storage tank is disposed on the toilet main body.

However, in the present invention, because the storage tank may be securely and stably fixed to the toilet main body by the fixing portions of the storage tank, wobbling of the storage tank may be prevented.

Furthermore, even when the toilet main body is made of ceramics, occurrence of air entrapment due to wobbling of the storage tank may be prevented, and a greater amount of flush water may be stored in the storage tank.

In the present invention, preferably, the storage tank includes a top tank section and a bottom tank section that are joined to each other in the up-down direction, and the fixing portions are provided at least on the bottom tank section among the top tank section and the bottom tank section, with the number of the fixing portions being greater for the bottom tank section than for the top tank section.

According to the flush toilet described above, the fixing portions of the storage tank to be fixed to the toilet main body may be provided at least on the bottom tank section among the top tank section and the bottom tank section that are joined to each other in the up-down direction, in such a manner that the number of the fixing portions is greater for the bottom tank section than for the top tank section.

Accordingly, because the fixing portions of the storage tank may be concentrated on the bottom tank section side as much as possible, an assembly error and the like may be reduced at the time of fixing the fixing portions of the storage tank after assembling the storage tank with the toilet main body.

Tilting of the storage tank may thus be prevented, and occurrence of air entrapment due to tilting of the storage tank may be prevented.

Furthermore, weight of flush water in the storage tank is mainly supported from below by the bottom tank section. Accordingly, because the storage tank may be more stably fixed to the toilet main body when a greater number of the fixing portions of the storage tank is provided on the bottom tank section than on the top tank section, tilting of the storage tank may be more reduced.

Furthermore, compared with a case where a greater number of the fixing portions of the storage tank is provided on the top tank section than on the bottom tank section, it is possible to reduce the risk of occurrence of air entrapment in the storage tank due to warping or the like of the upper surface of the storage tank caused by deformation of the top tank section under a fixing load and the like applied to the fixing portions.

Moreover, when a greater number of the fixing portions of the storage tank is provided on the bottom tank section than on the top tank section, an upper space and the like of the top tank section required for the fixing portions of the storage tank may be reduced. This enables the height of an upper end position of the storage tank to be set as low as possible, and a low silhouette may be achieved for the entire flush toilet.

In the present invention, preferably, the storage tank has a left-right asymmetrical shape including a large tank section and a small tank section, the large tank section being a large-capacity side of the storage tank that is divided into two at a center in a left-right direction, the small tank section being a small-capacity side of the storage tank that is divided into two at the center in the left-right direction, a surface of the toilet main body facing the large tank section in a front-back direction forms a sloping surface that slopes obliquely downward to below the storage tank, and in a state where the fixing portions of the storage tank are fixed to the toilet main body, a front end portion of the large tank section is disposed adjacent to the sloping surface of the toilet main body in a manner sloping along the sloping surface of the toilet main body.

According to the flush toilet described above, because the surface of the toilet main body facing the large tank section of the storage tank in the front-back direction forms a sloping surface that slopes obliquely downward to below the storage tank, and the front end portion of the large tank section of the storage tank is disposed adjacent to the sloping surface of the toilet main body in a manner sloping along the sloping surface of the toilet main body, even if the storage tank is tilted due to occurrence of a trouble such as the fixing portion of the storage tank being damaged, for example, the front end portion of the storage tank may abut against the sloping surface of the toilet main body that is adjacent and facing the front end portion.

The storage tank may thus be prevented from being greatly tilted, and occurrence of air entrapment due to tilting of the storage tank may be reliably prevented.

With the flush toilet of the present invention, air entrapment due to tilting of the storage tank may be prevented, and a greater amount of flush water may be stored in the storage tank, and also, occurrence of abnormal noise due to trapped air may be prevented.

DETAILED DESCRIPTION OF THE PREFERRED EMBODIMENT

Hereinafter, a flush toilet according to an embodiment of the present invention will be described with reference to the appended drawings.

Figure 1:
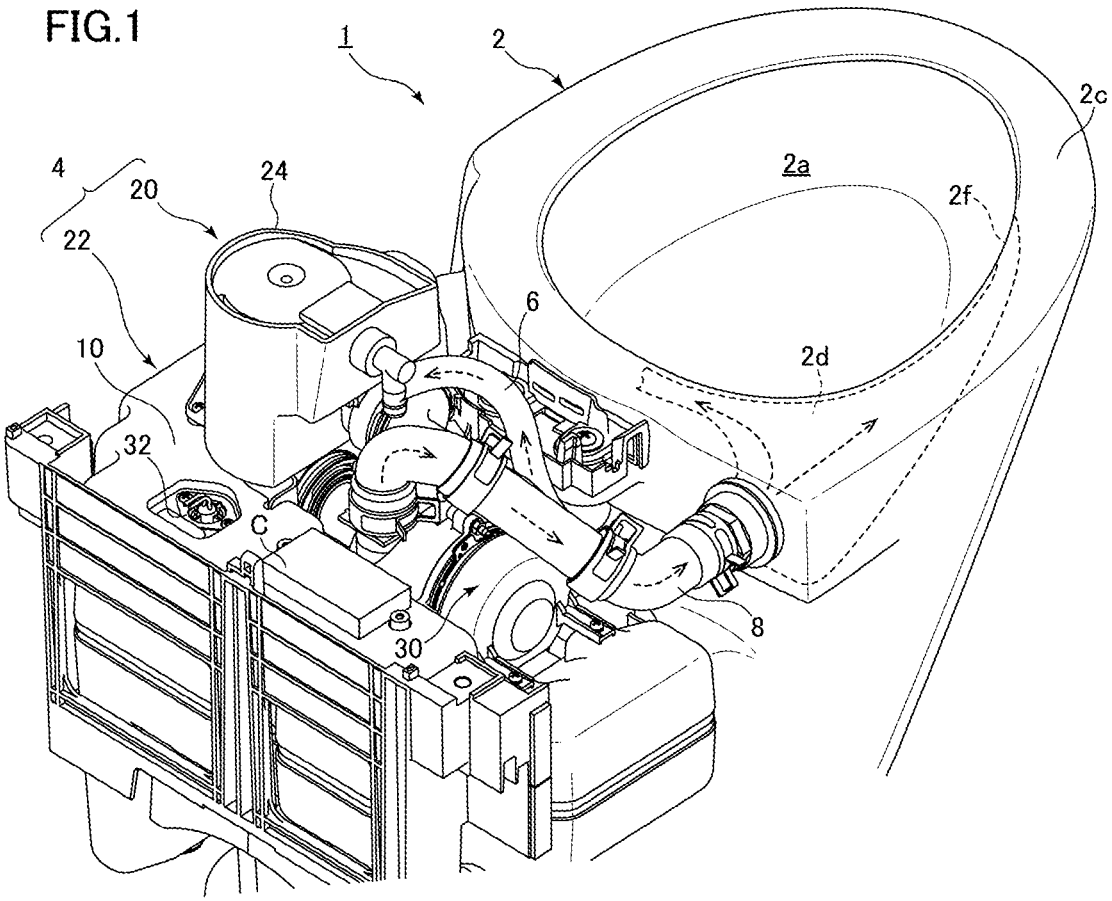
FIG. 1 is a schematic perspective view showing a flush toilet according to an embodiment of the present invention, where the flush toilet is seen obliquely from behind and above.

First, FIG. 1 is a schematic perspective view showing the flush toilet according to the embodiment of the present invention, where the flush toilet is seen obliquely from behind and above. Furthermore, FIG. 2 is an overall configuration diagram of the flush toilet according to the embodiment of the present invention.

Figure 2:
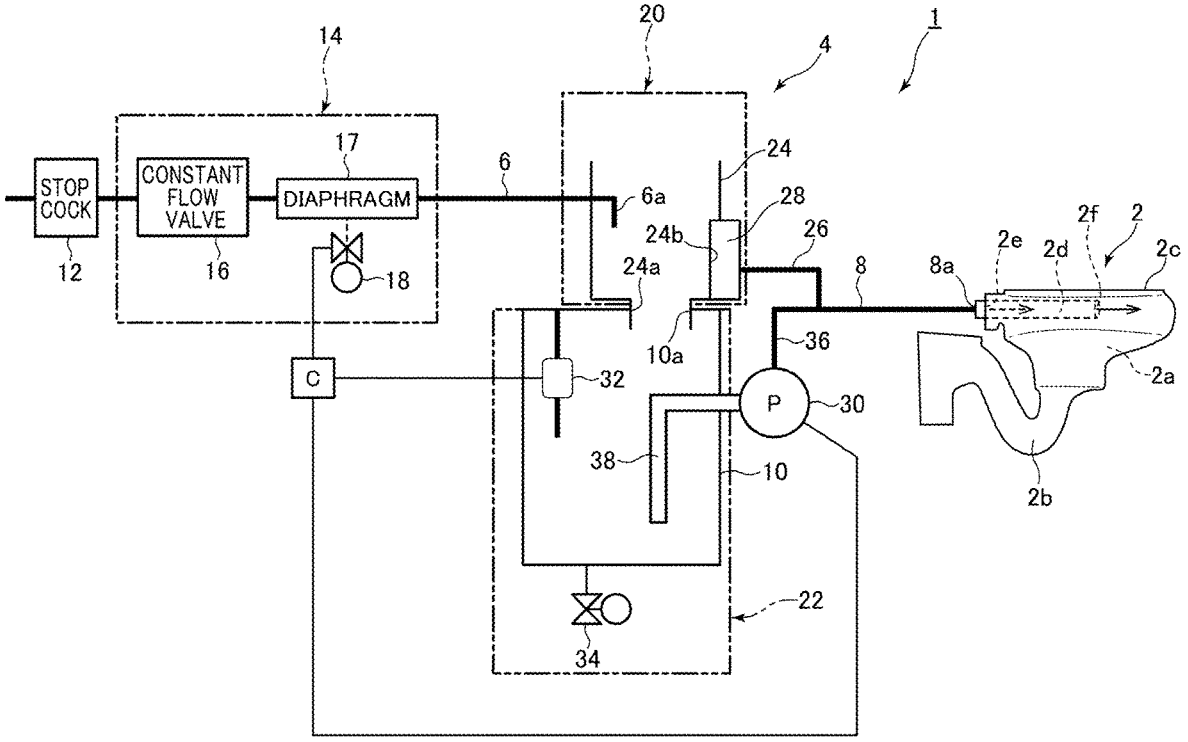
FIG. 2 is an overall configuration diagram of the flush toilet according to the embodiment of the present invention.

As shown in FIGS. 1 and 2, a flush toilet 1 according to the embodiment of the present invention includes a toilet main body 2 made of ceramics, and a tank device 4 that is provided behind the toilet main body 2.

Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim 2*c* formed at a top edge of the bowl 2*a*.

Next, as shown in FIGS. 1 and 2, the tank device 4 includes a water supply pipe 6 and a water discharge pipe 8 that are connected, respectively, on an upstream side and a downstream side of the tank device 4.

An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10.

Furthermore, a stop cock 12 and a valve unit 14 are provided on the water supply pipe 6, from the upstream side to the downstream side.

Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10.

At the valve unit 14, a flow rate of flush water in the water supply pipe 6 is adjusted to be constant by the fixed flow valve 16.

Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20.

As shown in FIG. 2, the connecting unit 20 includes a water receiving housing 24, an overflow pipe 26, and a check valve 28.

Moreover, a lower opening 24*a* of the water receiving housing 24 is detachably connected to an upper opening (a water passage port 10*a*) of the storage tank 10 of the tank unit 22.

The overflow pipe 26 connects an overflow port 24*b* provided in a part of a side wall of the water receiving housing 24 and the water discharge pipe 8.

The water discharge pipe 8 is a connecting pipe (a flush water supply pipe), an upstream side of the water discharge pipe 8 is connected to a pump 30 of the tank device 4, and a downstream side of the water discharge pipe 8 is connected to a rim conduit 2*d* inside the rim 2*c* of the toilet main body 2.

Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

Next, as shown in FIG. 2, the tank unit 22 includes the storage tank 10, the pump 30, a float switch 32, a drain plug 34, a controller C and the like.

The pump 30 is provided on a part (midstream) of a water passage pipe 36 connected on an upstream side of the water discharge pipe 8. An upstream end 36*a* of the water passage pipe 36 is connected to a downstream end 38*a* of a suction pipe 38 provided in the storage tank 10.

Flush water stored in the storage tank 10 is suctioned from the suction pipe 38 into the water passage pipe 36 by operation of the pump 30, and is then fed under pressure to the water discharge pipe 8 via the pump 30.

All the flush water that is supplied from the storage tank 10 to the water discharge pipe 8 by the pump 30 is thus supplied into the rim conduit 2*d* from an inlet 2*e* of the rim conduit 2*d*.

Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed.

That is, the water passage pipe 36 and the water discharge pipe 8 each function as a flush water supply pipe for supplying flush water that is fed under pressure from the storage tank 10 by the pump 30 to the toilet main body 2.

The float switch 32 detects a water level inside the storage tank 10. An opening/closing operation of the electromagnetic valve 18 of the valve unit 14 is controlled by the controller C based on the water level inside the storage tank 10 that is detected by the float switch 32.

Furthermore, the operation of the pump 30 is also controlled by the controller C based on the water level inside the storage tank 10 that is detected by the float switch 32.

For example, in the case where the water level inside the storage tank 10 that is detected by the float switch 32 is at or below a predetermined water level, the electromagnetic valve 18 is opened, the water supply pipe 6 is released, and the pump 30 is caused to operate.

Then, when the water level inside the storage tank 10 reaches the predetermined water level, the electromagnetic valve 18 is closed, the water supply pipe 6 is closed, and the pump 30 is stopped.

The drain plug 34 is provided in a bottom surface of the storage tank 10. In normal use, the drain plug 34 is closed at all times, and the drain plug 34 can be removed as necessary to discharge the flush water in the storage tank 10 to outside.

Next, details of the storage tank 10 of the tank unit 22 will be given with reference to FIGS. 3 to 6.

Figure 3:
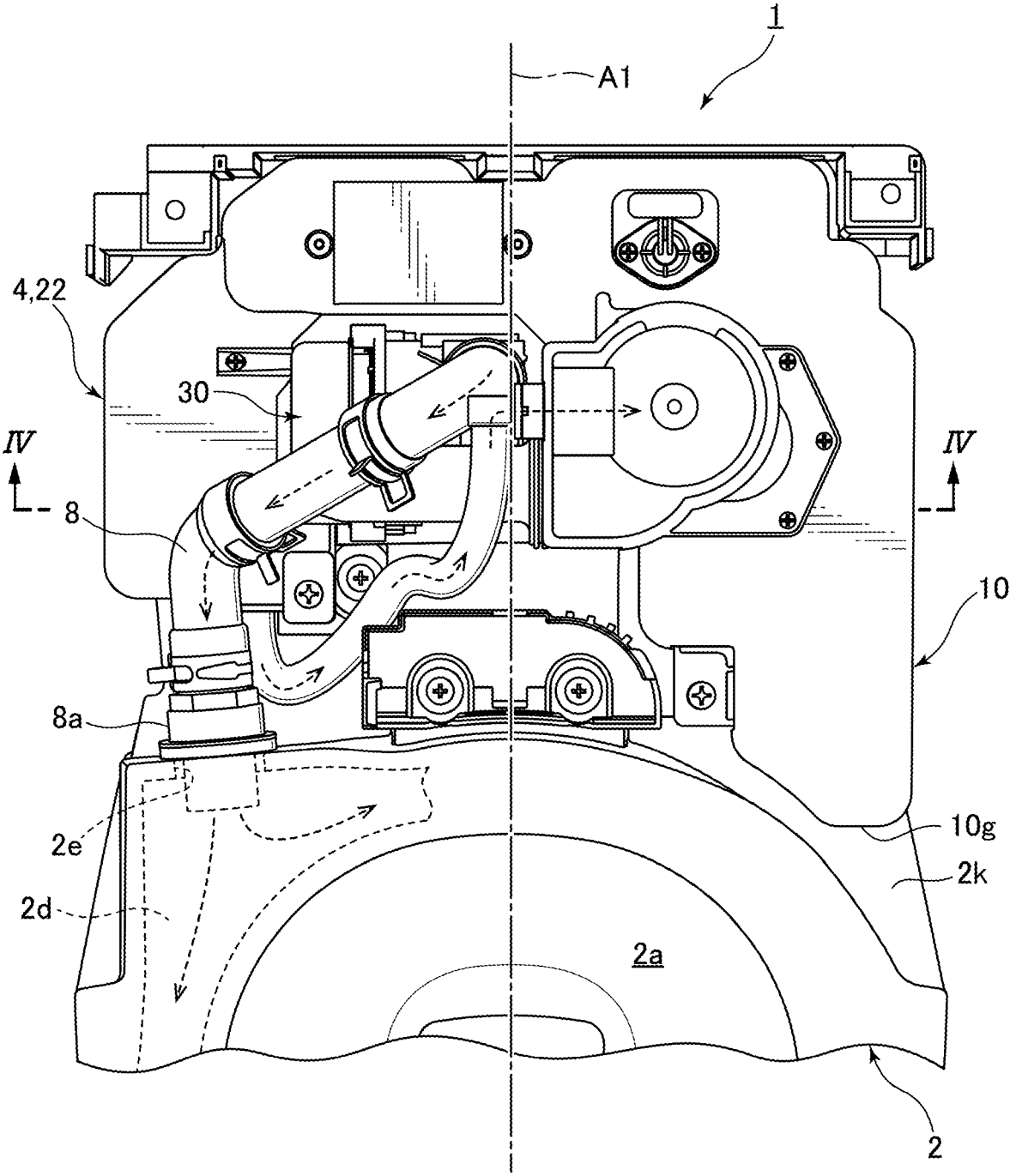
FIG. 3 is an enlarged partial plan view showing a part of the flush toilet according to the embodiment of the present invention in an enlarged manner, the part corresponding to a tank unit.

FIG. 3 is an enlarged partial plan view showing a part of the flush toilet according to the embodiment of the present invention in an enlarged manner, the part corresponding to the tank unit. Furthermore, FIG. 4 is a cross-sectional view taken along a line IV-IV in FIG. 3.

Figure 4:
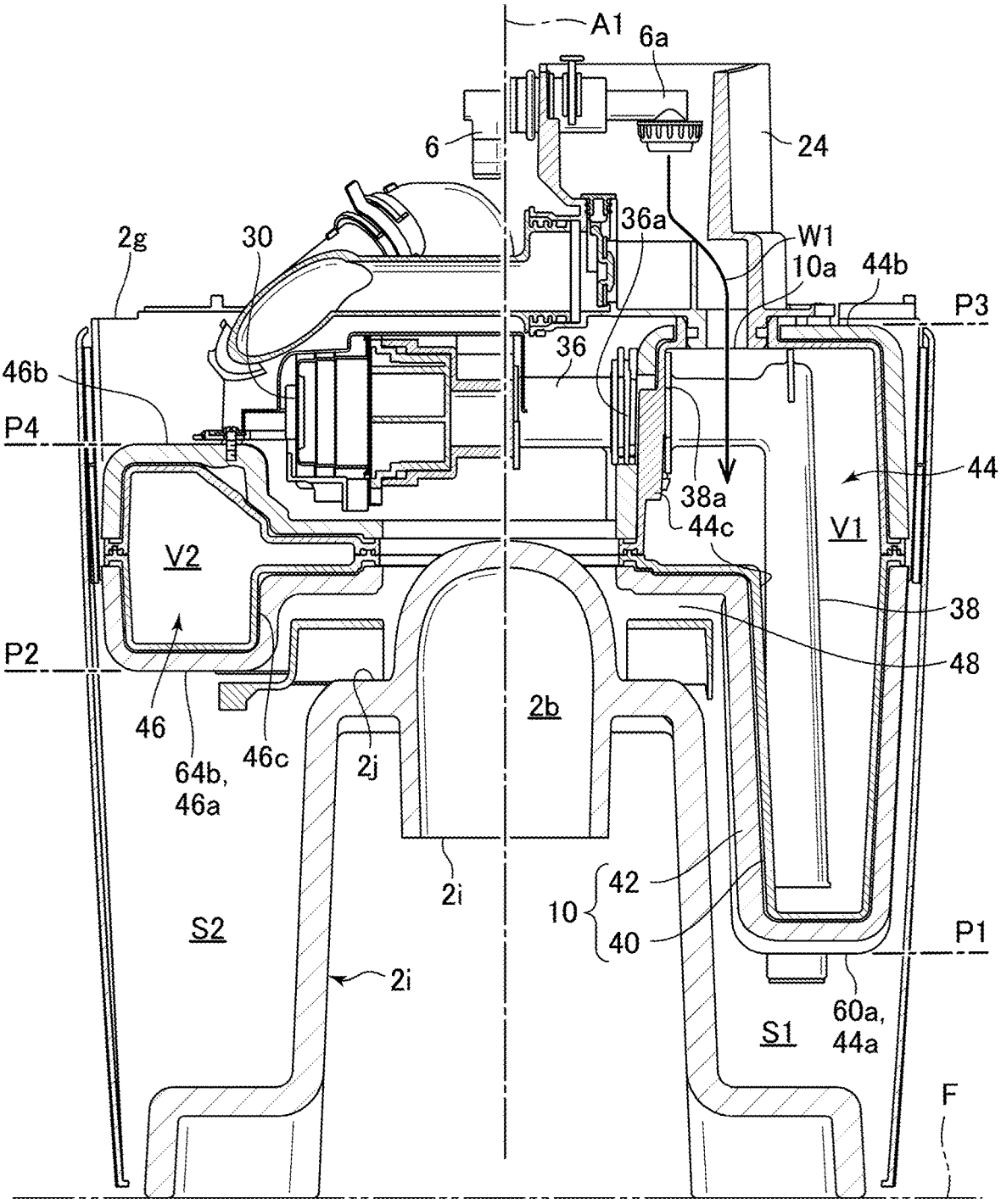
FIG. 4 is a cross-sectional view taken along a line IV-IV in FIG. 3.

First, as shown in FIGS. 3 and 4, the storage tank 10 of the tank unit 22 includes a single tank main body 40, and an antisweat material 42 covering an outside of the tank main body 40.

Figure 5:
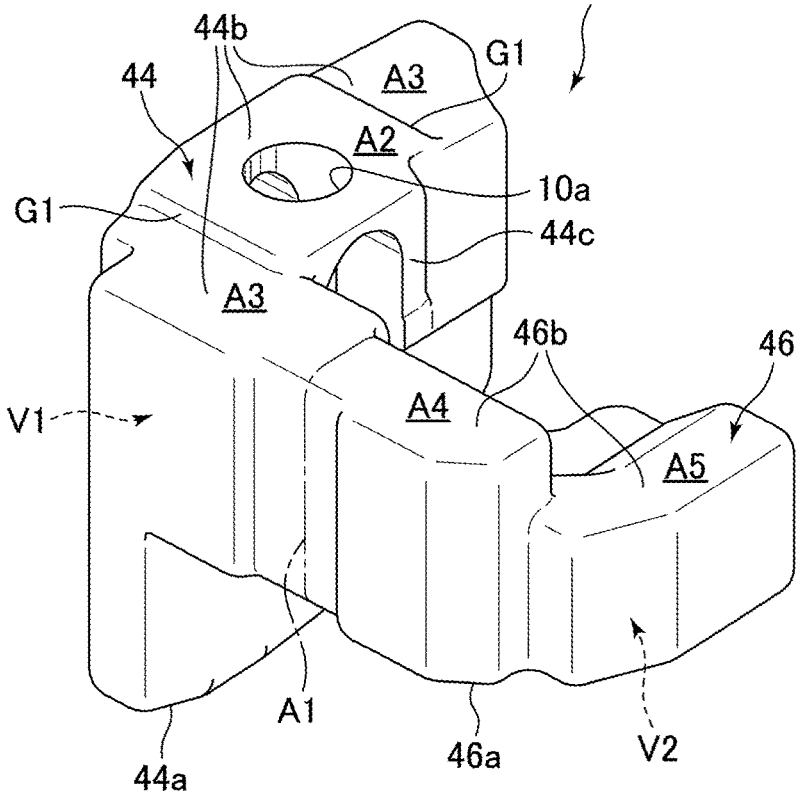
FIG. 5 is a perspective view showing a storage tank of the flush toilet according to the embodiment of the present invention, where the storage tank is seen obliquely from behind and above.

Next, FIG. 5 is a perspective view showing the storage tank of the flush toilet according to the embodiment of the present invention, where the storage tank is seen obliquely from behind and above. Furthermore, FIG. 6 is a rear view of the storage tank of the flush toilet according to the embodiment of the present invention.

As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46.

Figure 6:
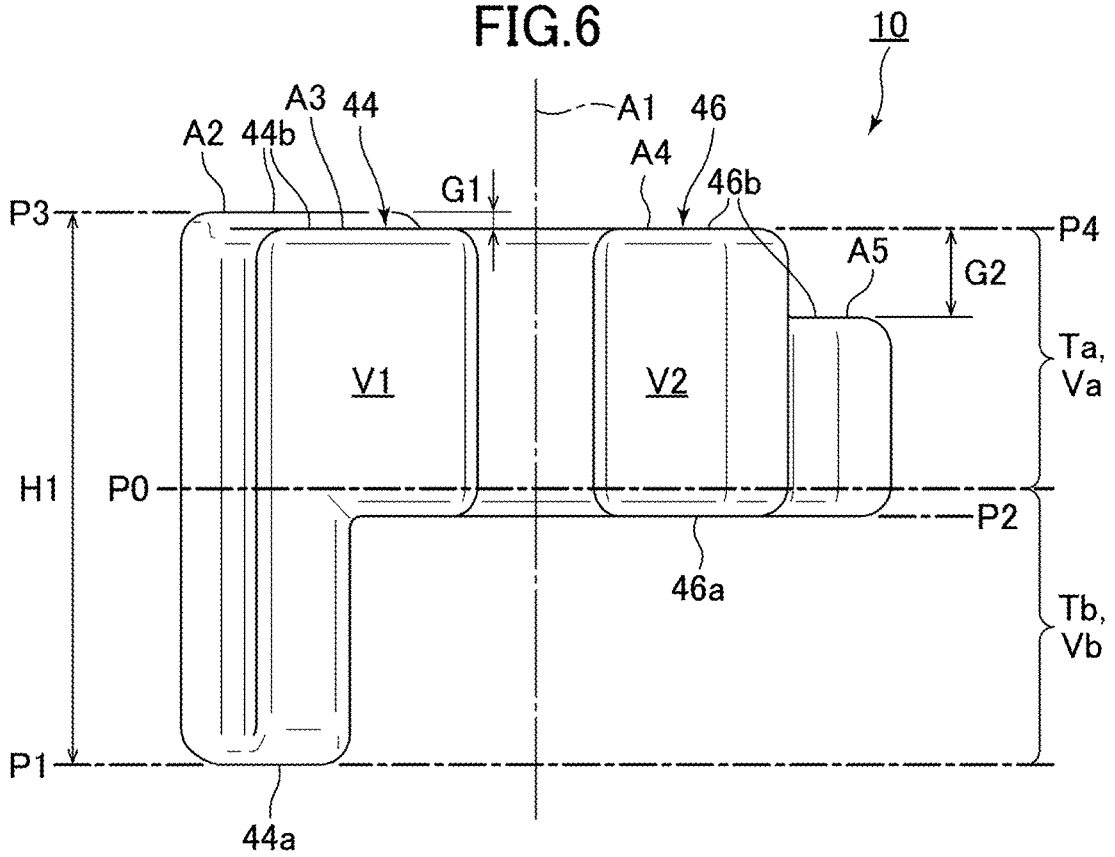
FIG. 6 is a rear view of the storage tank of the flush toilet according to the embodiment of the present invention.

That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 are disposed on a right side of the vertical plane A1, and a capacity V1 of the large tank section 44 is set greater than a capacity V2 of the small tank section 46 (V1>V2).

Accordingly, because of the large tank section 44 and the small tank section 46, the storage tank 10 has a left-right asymmetrical shape (a deformed shape of an approximately C-shape or U-shape in a plan view).

Next, as shown in FIG. 4, the toilet main body 2 includes, in a region behind the bowl 2*a*, a large-tank housing section S1 and a small-tank housing section S1 for housing the large tank section 44 and the small tank section 46, respectively, at a position higher than a floor surface.

That is, in the region behind the bowl 2*a* of the toilet main body 2, the large-tank housing section S1 is formed on one of left and right sides of the vertical plane A1 that divides the region into two in the left-right direction (on the right side of the vertical plane A1 when the toilet main body 2 is seen from front).

In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position P1 of a bottom surface 44*a* of the large tank section 44 is located below a lowest position P2 of a bottom surface 46*a* of the small tank section 46.

Furthermore, as shown in FIGS. 4 to 6, in the state where the large tank section 44 and the small tank section 46 are disposed in the large-tank housing section S1 and the small-tank housing section S2, respectively, a position P3 (a highest position P3) of an upper surface 44*b* of the large tank section 44 is located above a position P4 of an upper surface 46*b* of the small tank section 46 and lower than an upper surface 2*g* of the rim 2*c* of the toilet main body 2.

Additionally, a tank mounting member 48, of which more later, is fixed behind the toilet main body 2, and the storage tank 10 may be attached to the tank mounting member 48 from above. That is, the storage tank 10 is indirectly attached to the toilet main body 2 via the tank mounting member 48.

Additionally, the storage tank 10 may alternatively be directly attached to the toilet main body 2, without providing the tank mounting member 48.

Next, as shown in FIG. 6, a capacity Va of an upper part Ta of the storage tank 10 that is located at a position higher than a middle height position (a middle height position P0 in an up-down direction) that equally divides a distance (a vertical-direction distance H1) between the lowest position P1 and the highest position P3 of the large tank section 44 of the storage tank 10 in the up-down direction into two is set greater than a capacity Vb of a lower part Vb of the storage tank 10 that is located at a position lower than the middle height position P0 (Va>Vb).

Furthermore, as shown in FIGS. 4 to 6, the upper surface 44*b* of the large tank section 44 of the storage tank 10 and the upper surface 46*b* of the small tank section 46 each include a height difference.

Particularly, the water passage port 10*a* is provided in a highest surface A2 of the upper surface 44*b* of the large tank section 44 of the storage tank 10 in a manner penetrating the highest surface A2 in a vertical direction. Thanks to the water passage port 10*a*, flush water W1 supplied to the water receiving housing 24 from a water supply nozzle 6*a* (see FIGS. 2 and 4) that is a water supply device connected to a downstream end of the water supply pipe 6 flows into the storage tank 10 to be stored.

Additionally, the present embodiment describes a mode where, in relation to the storage tank 10, the upper surfaces of the large tank section 44 and the small tank section 46 with a height difference to each other are flat surfaces, but such a mode is not restrictive, and a mode is also possible where the highest surface of the storage tank 10 is a flat surface and a height difference is generated by including a surface that slopes downward from the highest surface, for example.

Furthermore, as shown in FIGS. 5 and 6, the upper surface 44*b* of the large tank section 44 of the storage tank 10 is formed such that the upper surface 44*b* becomes lower in a continuous or stepwise manner across a small step G1, from the surface A2 where the water passage port 10*a* is formed toward a surface A3 on an outer periphery of the surface A2.

Additionally, the upper surface 44*b* of the large tank section 44 of the storage tank 10 may be formed as a tapered shape, with the upper surface 44*b* sloping downward in a continuous manner from the surface A2 where the water passage port 10*a* is formed toward the surface A3 on the outer periphery of the surface A2, or the upper surface 44*b* may be formed such that the upper surface 44*b* becomes lower in a stepwise manner with a step larger than the small step G1 mentioned above.

Moreover, in relation to the upper surface 46*b* of the small tank section 46 of the storage tank 10, a surface A4 extends in a horizontal left-right direction at a same height as the upper surface A3 of the large tank section 44, and a flat surface A5 is formed at a lower position across a step G2.

As shown in FIGS. 2 and 4, the suction pipe 38 is provided inside the large tank section 44 of the tank main body 40, and the upstream end 36*a* of the water passage pipe 36 extending on an upstream side (sideways) from the pump 30 is connected to the downstream end 38*a* of the suction pipe 38, that is a part of the large tank section 44, in a watertight manner.

Furthermore, as shown in FIG. 3, an upstream end of the water discharge pipe 8 is connected to a downstream end of the water passage pipe 36 extending on a downstream side (upward) from the pump 30, and a downstream end (an outlet 8*a*) of the water discharge pipe 8 is connected to the inlet 2*e* of the rim conduit 2*d* on the other one of the left and right sides of the vertical plane A1 of the toilet main body 2 (on the left side of the vertical plane A1 when the toilet main body 2 is seen from the front).

Next, as shown in FIG. 4, a side wall surface 44*c* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front).

Likewise, a side wall surface 46*c* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front).

Furthermore, as shown in FIGS. 4 and 5, the discharge trap pipe 2*b* is provided at the center of the toilet main body 2 in the left-right direction, and the upstream end 36*a* of the water passage pipe 36 is connected to the side wall surface 44*c* that is the side surface, of the large tank section 44, on the discharge trap pipe 2*b* side, of left and right side surfaces of the large tank section 44.

Furthermore, as shown in FIGS. 3 and 4, the pump 30 is disposed behind the bowl 2*a* of the toilet main body 2, at a position higher than the discharge trap pipe 2*b*.

Moreover, the pump 30 is disposed in a space between the large tank section 44 and the small tank section 46 in the left-right direction, more to the center of the toilet main body 2 in the left-right direction than the upstream end 36*a* of the water passage pipe 36 and the downstream end (the outlet 8*a*) of the water discharge pipe 8.

Next, a specific description will be given with reference to FIG. 4 and FIGS. 7 to 14, of the tank mounting member 48, mentioned above, that is fixed to the toilet main body 2, and of an attachment structure between a fixing portion (an attaching portion M1) of the storage tank 10 and an attachment-receiving portion M2 of the tank mounting member 48.

Figure 7:
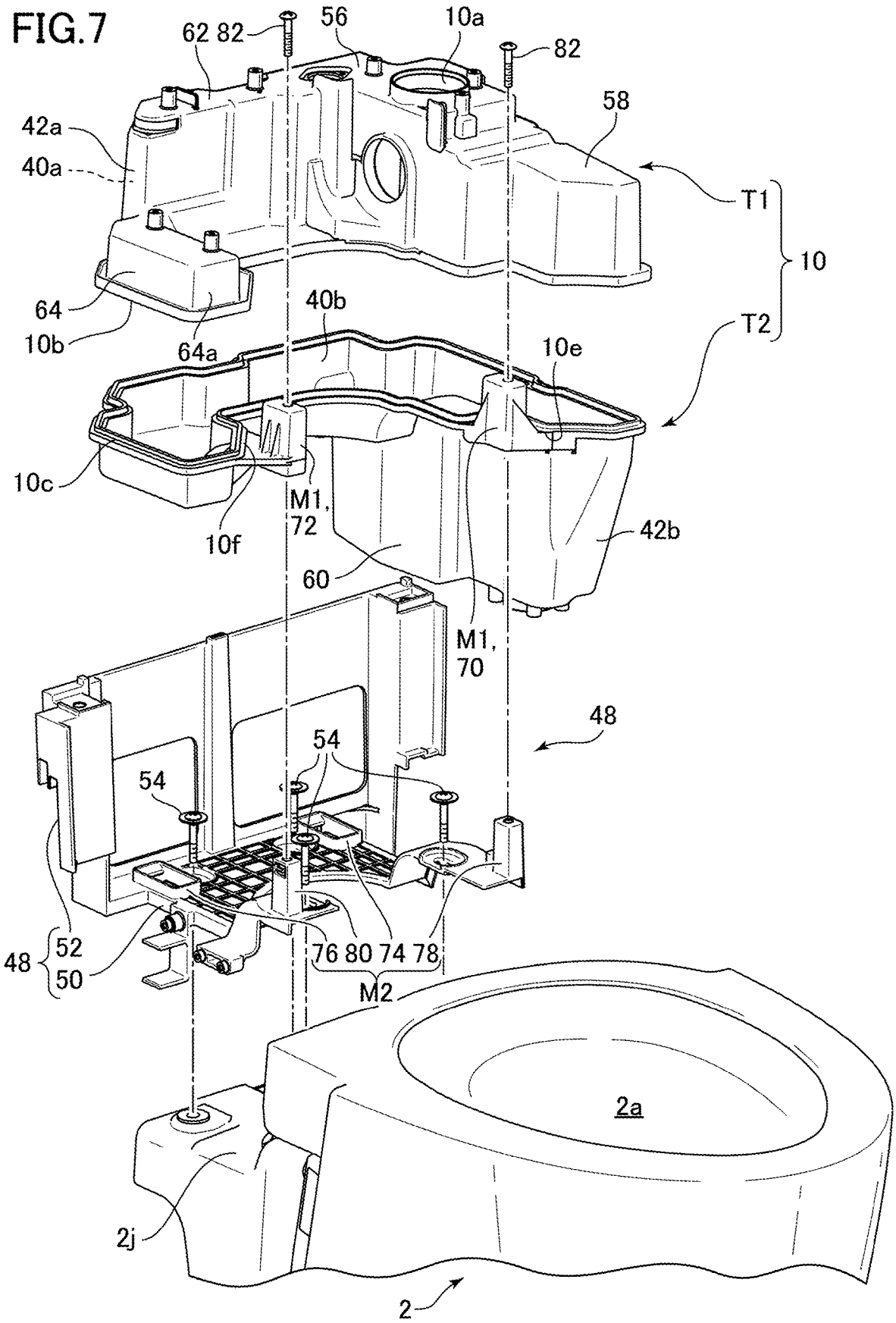
FIG. 7 is an exploded perspective view showing a toilet main body, a tank mounting member, and the storage tank of the flush toilet according to the embodiment of the present invention.

First, FIG. 7 is an exploded perspective view showing the toilet main body, the tank mounting member, and the storage tank of the flush toilet according to the embodiment of the present invention.

Figure 8:
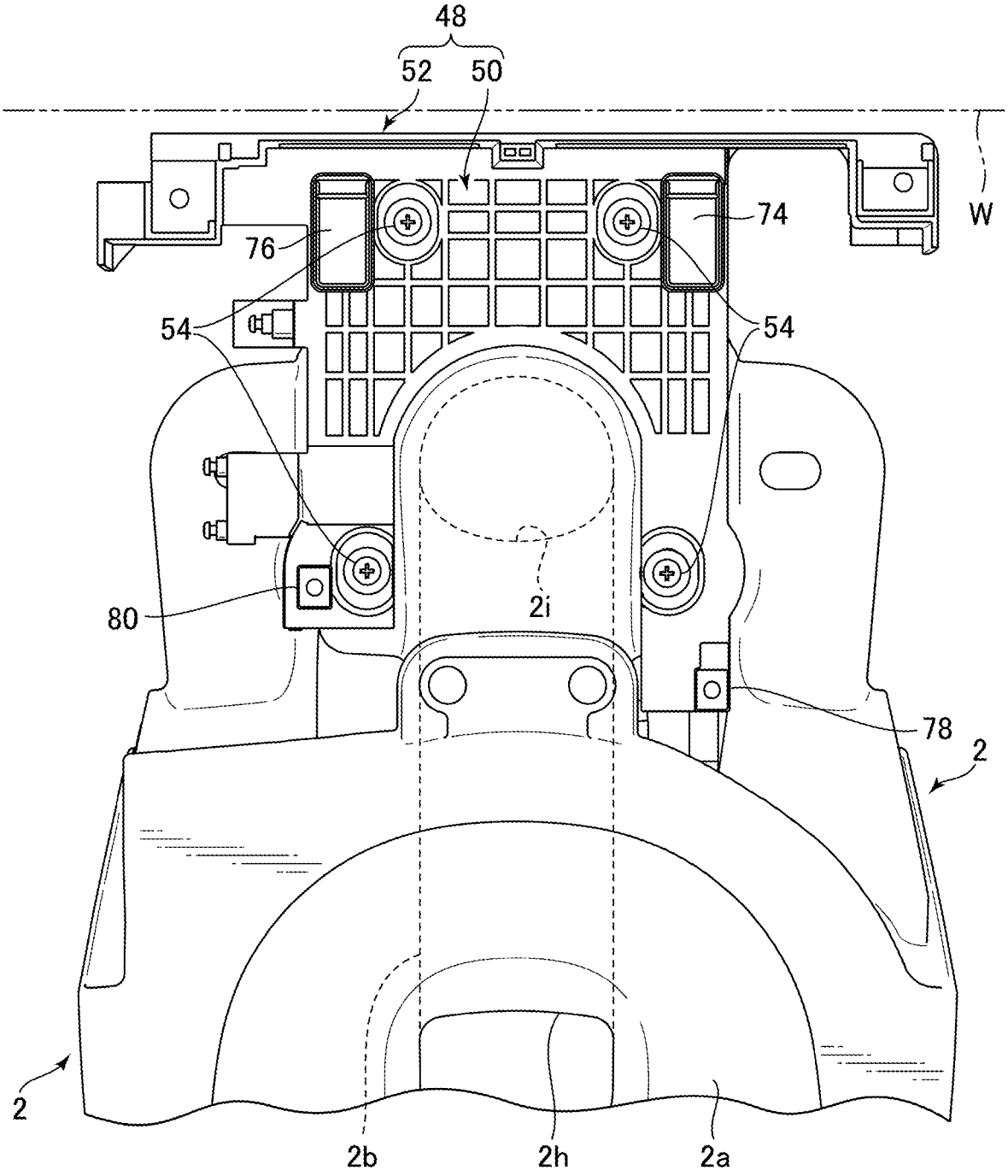
FIG. 8 is a plan view showing a state where the tank mounting member is attached to the toilet main body of the flush toilet according to the embodiment of the present invention.

Next, FIG. 8 is a plan view showing a state where the tank mounting member is attached to the toilet main body of the flush toilet according to the embodiment of the present invention.

Figure 9:
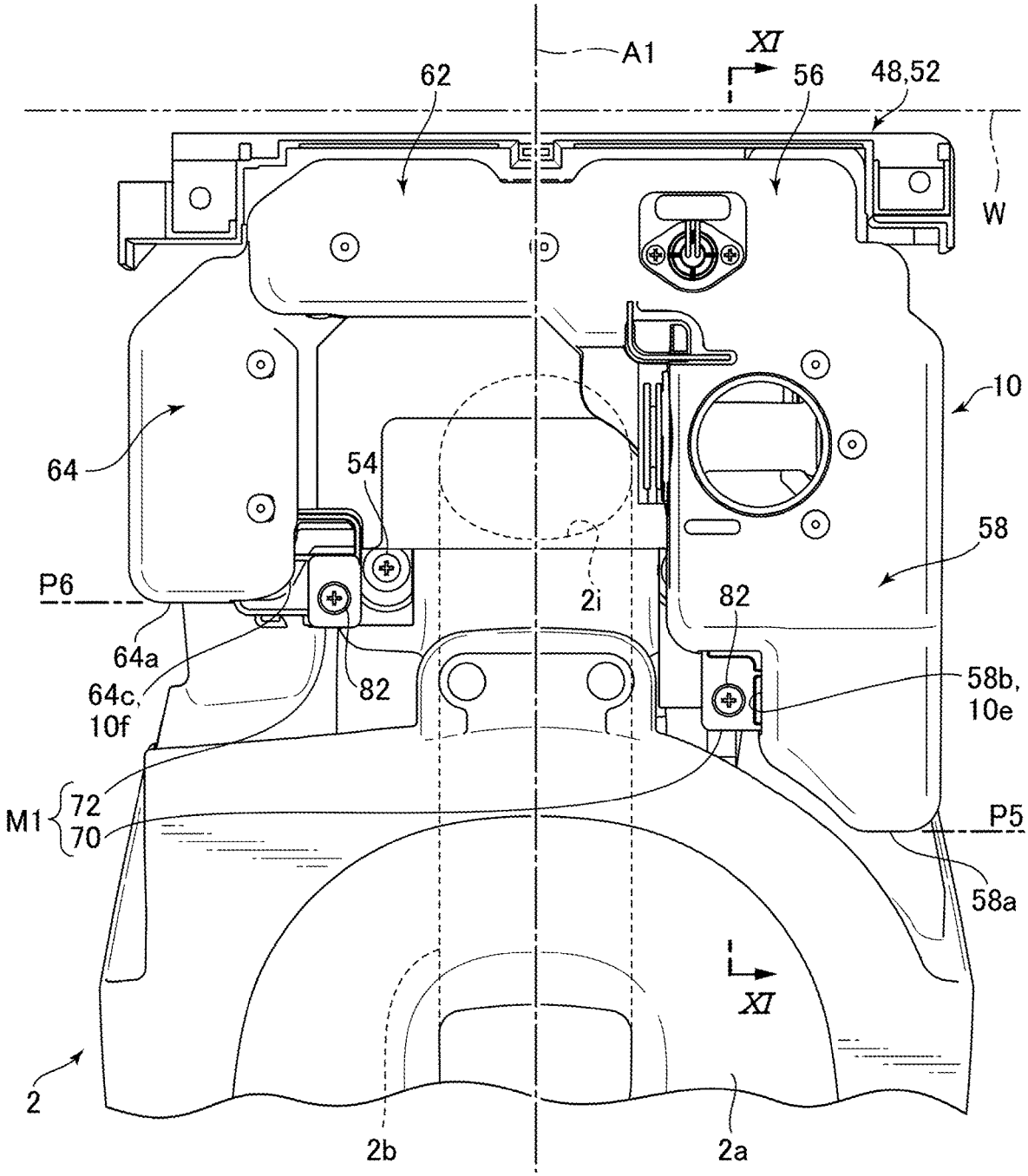
FIG. 9 is a plan view showing a state where the storage tank is attached, via the tank mounting member, to the toilet main body of the flush toilet according to the embodiment of the present invention.

Furthermore, FIG. 9 is a plan view showing a state where the storage tank is attached, via the tank mounting member, to the toilet main body of the flush toilet according to the embodiment of the present invention.

First, as shown in FIG. 4 and FIGS. 7 to 9, the tank mounting member 48 includes a base (a base plate 50) that is to be fixed behind the bowl 2*a* of the toilet main body 2, and a rear surface-side supporting plate 52 extending upward from a rear end of the base plate 50.

Furthermore, in plan views in FIGS. 8 and 9, the discharge trap pipe 2*b* of the toilet main body 2 extends in a front-back direction from an inlet 2*h* of the discharge trap pipe 2*b* connected to a lower part of the bowl 2*a* of the toilet main body 2 to an outlet 2*i* behind the bowl 2*a*.

Then, as shown in FIGS. 4, 7 and 8, a supporting surface 2*j* that is made of ceramics and to which the base plate 50 is to be fixed is formed at an upper part and on lateral sides of the discharge trap pipe 2*b* of the toilet main body 2, above the outlet 2*i* of the discharge trap pipe 2*b*.

Accordingly, the base plate 50 is fixed from above with a plurality (four) of screws 54 while being supported by the supporting surface 2*j* behind the toilet main body 2 from below.

Furthermore, as shown in FIGS. 8 and 9, in a state where the tank mounting member 48 is fixed to the toilet main body 2, the rear surface-side supporting plate 52 is disposed adjacent to an external wall surface W on a rear side.

Figure 10:
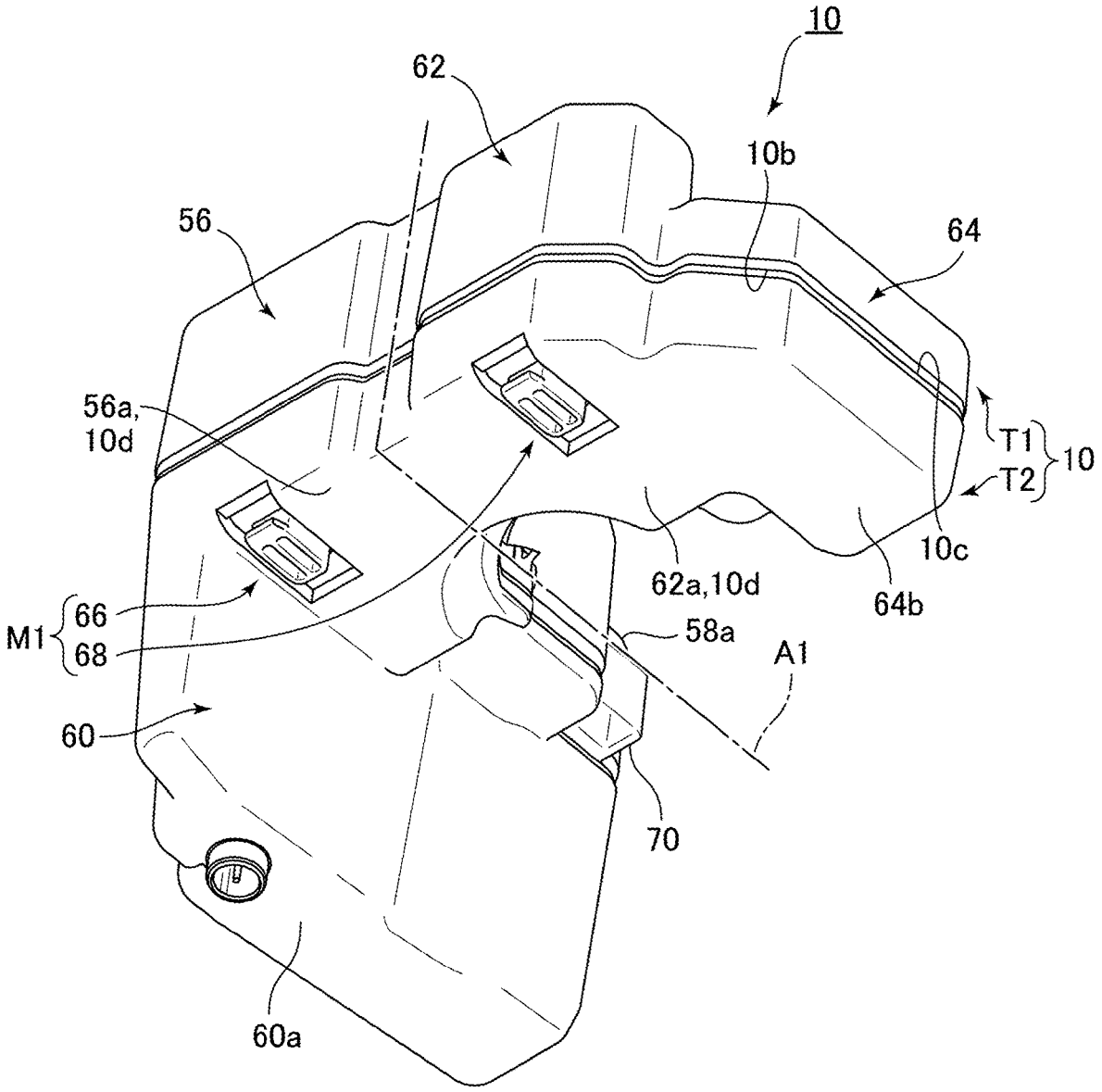
FIG. 10 is a perspective view of the storage tank of the flush toilet according to the embodiment of the present invention, where the storage tank is seen obliquely from behind and below.

Next, FIG. 10 is a perspective view of the storage tank of the flush toilet according to the embodiment of the present invention, where the storage tank is seen obliquely from behind and below. Furthermore, FIG. 11 is a cross-sectional view taken along a line XI-XI in FIG. 9, and is an enlarged partial cross-sectional view showing parts corresponding to the storage tank and the tank mounting member behind the toilet main body in an enlarged manner.

Figure 11:
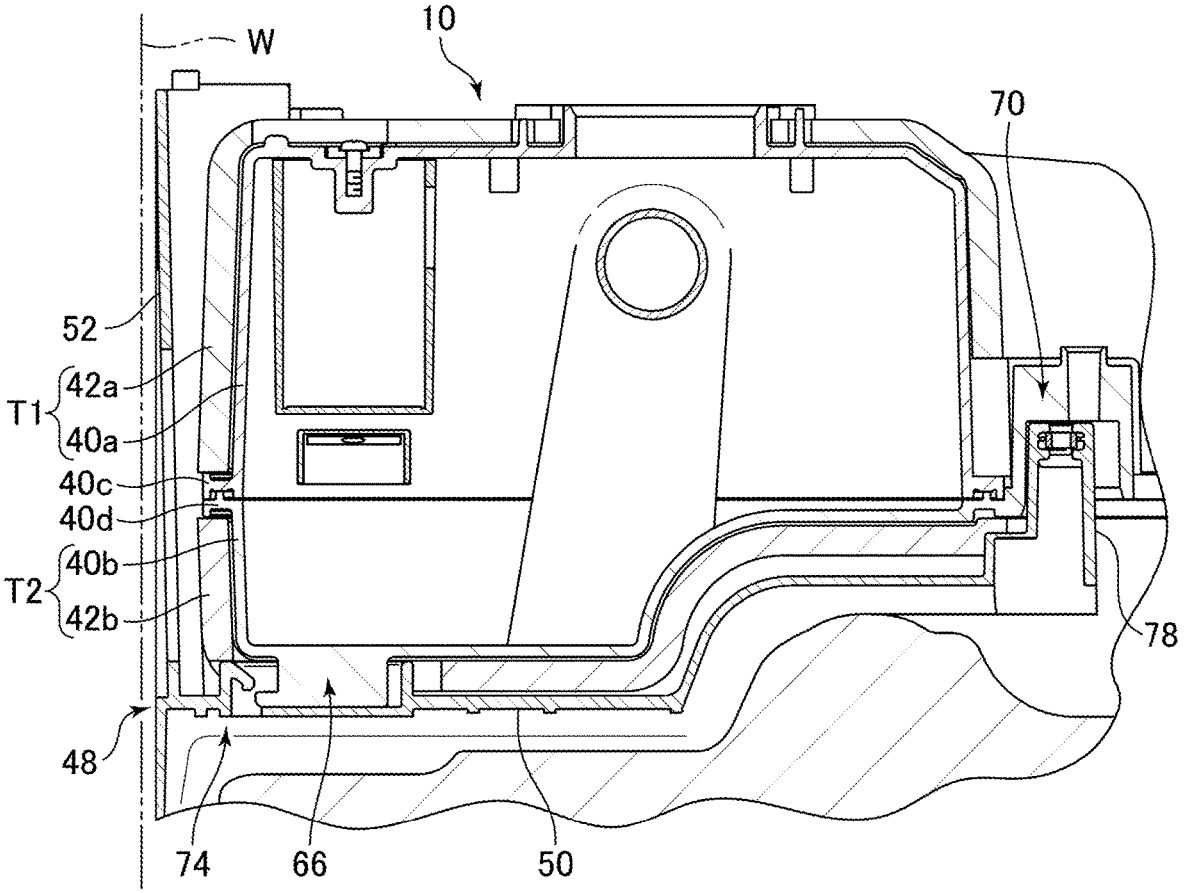
FIG. 11 is a cross-sectional view taken along a line XI-XI in FIG. 9, and is an enlarged partial cross-sectional view showing parts corresponding to the storage tank and the tank mounting member behind the toilet main body in an enlarged manner.

First, as shown in FIGS. 7, 10 and 11, the storage tank 10 includes a top tank section (a top tank member T1) and a bottom tank section (a bottom tank member T2) that are joined to each other in the up-down direction.

Furthermore, the top tank member T1 includes an upper tank main body 40*a* and an upper antisweat material 42*a* on an outside of the upper tank main body 40*a*, and the bottom tank member T2 includes a lower tank main body 40*b* and a lower antisweat material 42*b* on an outside of the lower tank main body 40*b*.

That is, in a state where a lower-edge joining portion 10*b* of the top tank member T1 of the storage tank 10 and an upper-edge joining portion 10*c* of the bottom tank member T2 are joined together, a lower-edge joining portion 40*c* of the upper tank main body 40*a* of the top tank member T1 and an upper-edge joining portion 40*d* of the lower tank main body 40*b* of the bottom tank member T2 are joined together in a watertight manner to form a single tank main body 40.

Moreover, the tank main body 40 is covered on the outside with the upper antisweat material 42*a* and the lower antisweat material 42*b* from above and below.

Next, as shown in FIGS. 9 and 10, the large tank section 44 of the storage tank 10 includes a rear large tank section 56 disposed behind the discharge trap pipe 2*b*, a front large tank section 58 extending forward from the rear large tank section 56 while being disposed on the one of the left and right sides of the discharge trap pipe 2*b* (the right side when the toilet main body 2 is seen from the front), and a lower large tank section 60 extending downward from the rear large tank section 56.

Next, as shown in FIGS. 9 and 10, the small tank section 46 of the storage tank 10 includes a rear small tank section 62 disposed behind the discharge trap pipe 2*b*, and a front small tank section 64 extending forward from the rear small tank section 62 while being disposed on the other one of the left and right sides of the discharge trap pipe 2*b* (the left side when the toilet main body 2 is seen from the front).

Furthermore, as shown in FIGS. 9 and 10, a position P5 of a front end 58*a* of the front large tank section 58 is positioned more forward than a position P6 of a front end 64*a* of the front small tank section 64.

Moreover, as shown in FIGS. 4 and 10, a bottom surface 60*a* of the lower large tank section 60 is located below a bottom surface 62*a* of the rear small tank section 62 and a bottom surface 64*b* of the front small tank section 64.

Figure 12:
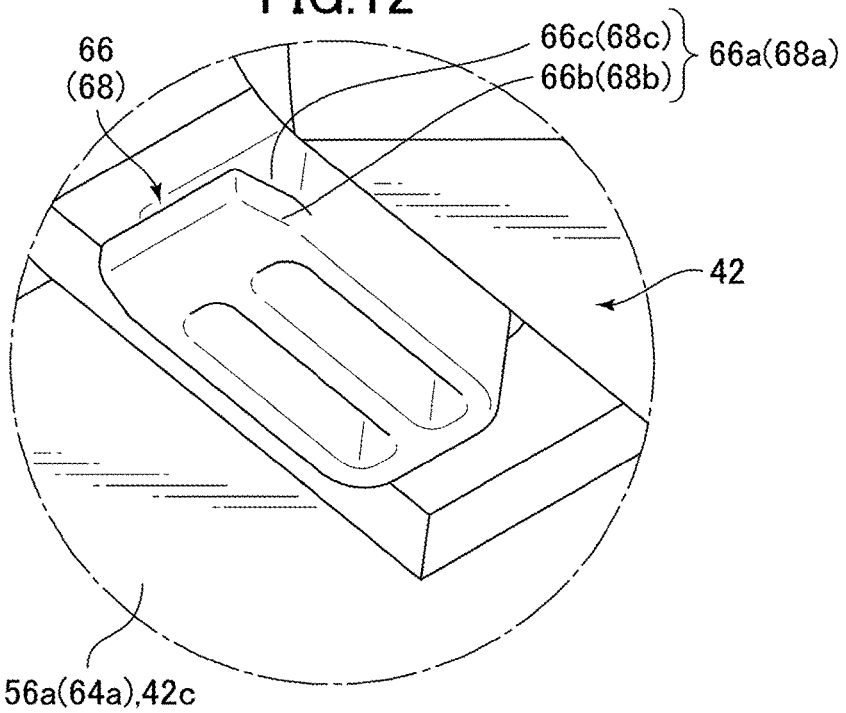
FIG. 12 is an enlarged partial view showing a part of the flush toilet according to the embodiment of the present invention in an enlarged manner, the part corresponding to an attaching portion of the storage tank shown in FIG. 10.

Next, FIG. 12 is an enlarged partial view showing a part of the flush toilet according to the embodiment of the present invention in an enlarged manner, the part corresponding to the attaching portion of the storage tank shown in FIG. 10.

First, as shown in FIG. 7 and FIGS. 9 to 11, the fixing portions (the attaching portions M1) of the storage tank 10 include, on a bottom surface 56*a* of the rear large tank section 56 of the storage tank 10 and a bottom surface 62*a* of the rear small tank section 62 (that is, a bottom surface 10*d* on a rearward side of the bottom tank member T2 of the storage tank 10 shown in FIG. 10), a pair of left and right large tank-side attaching portion (a rear attaching portion 66) and small tank-side attaching portion (a rear attaching portion 68).

Furthermore, as shown in FIG. 7 and FIGS. 9 to 11, the fixing portions (the attaching portions M1) of the storage tank 10 further include, on a part of an inner side surface 58*b* of the front large tank section 58 of the storage tank 10 and a part of an inner side surface 64*c* of the front small tank section 64 (that is, on inner side surfaces 10*e*, 10*f* of the bottom tank member T2 of the storage tank 10 shown in FIGS. 7 and 9), a left and right pair of large tank-side attaching portion (a front attaching portion 70) and small tank-side attaching portion (a front attaching portion 72).

That is, as the fixing portion of the storage tank 10 for fixing the storage tank 10 to the toilet main body 2 and the tank mounting member 48, a plurality of (four) attaching portions M1 (66, 68, 70, 72) are provided only on the bottom tank member T2 side, and no fixing portion is provided on the top tank member T1 side.

Additionally, the present embodiment describes a mode where a plurality of (four) fixing portions of the storage tank 10 are provided only on the bottom tank member T2, but the plurality of fixing portions are not limited to four.

Alternatively, the fixing portion of the storage tank 10 may be provided on each of the top tank member T1 and the bottom tank member T2. In this case, the number of fixing portions of the storage tank 10 is desirably greater for the bottom tank member T2 than for the top tank member T1.

As shown in FIGS. 7, 8 and 11, the attachment-receiving portion M2 of the tank mounting member 48 includes a pair of left and right rear attachment-receiving portions 74, 76 that are provided on a rear side on the base plate 50 of the tank mounting member 48. The rear attaching portions 66, 68 of the storage tank 10 can be attached to the corresponding attachment-receiving portions 74, 76 from above.

Furthermore, as shown in FIGS. 7, 8 and 11, the attachment-receiving portion M2 of the tank mounting member 48 further includes a pair of left and right front attachment-receiving portions 78, 80 that are provided on a front side of the base plate 50 of the tank mounting member 48. The front attaching portions 70, 72 of the storage tank 10 can be attached to the corresponding attachment-receiving portions 78, 80 from above.

Additionally, the attaching portions 66, 70 of the storage tank 10 and the attachment-receiving portions 74, 78 of the tank mounting member 48 shown in FIG. 11 are in a state where the attaching portions 66, 70 of the storage tank are attached and engaged with the corresponding attachment-receiving portions 74, 78 of the tank mounting member 48 from above but are not yet fixed to each other.

Next, FIG. 12 is an enlarged partial view showing a part of the flush toilet according to the embodiment of the present invention in an enlarged manner, the part corresponding to the attaching portion of the storage tank shown in FIG. 10.

Figure 13A:
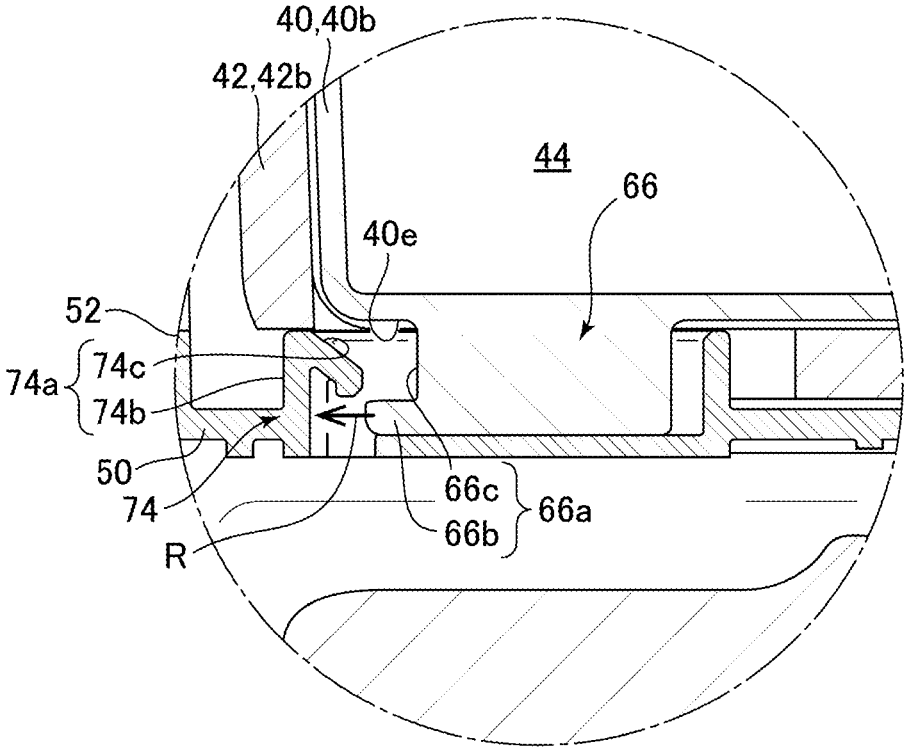
FIG. 13A is an enlarged partial cross-sectional view showing a part of the flush toilet according to the embodiment of the present invention shown in FIG. 11 in an enlarged manner, the part corresponding to a large-tank rear attaching portion of the storage tank and a rear attachment-receiving portion of the tank mounting member, FIG. 13A showing a state before the large-tank rear attaching portion of the storage tank is moved rearward after being engaged with the rear attachment-receiving portion of the tank mounting member from above (a pre-positioning state)

Furthermore, FIG. 13A is an enlarged partial cross-sectional view showing a part of the flush toilet according to the embodiment of the present invention shown in FIG. 11 in an enlarged manner, the part corresponding to the large-tank rear attaching portion of the storage tank and the rear attachment-receiving portion of the tank mounting member, FIG. 13A showing a state before the large-tank rear attaching portion of the storage tank is moved rearward after being engaged with the rear attachment-receiving portion of the tank mounting member from above (a pre-positioning state).

Figure 13B:
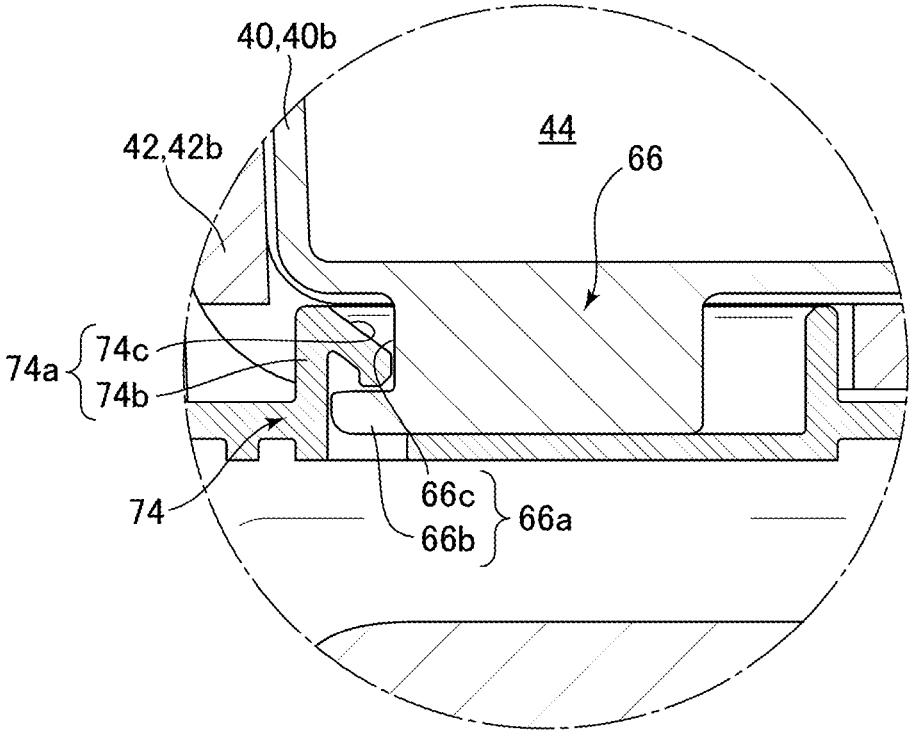
FIG. 13B is, like FIG. 13A, an enlarged partial cross-sectional view showing a part of the flush toilet according to the embodiment of the present invention in an enlarged manner, the part corresponding to the large-tank rear attaching portion of the storage tank and the rear attachment-receiving portion of the tank mounting member, FIG. 13B showing a state where the large-tank rear attaching portion of the storage tank is moved rearward after being engaged with the rear attachment-receiving portion of the tank mounting member from above and positioning is completed (a positioning completion state)

FIG. 13B is, like FIG. 13A, an enlarged partial cross-sectional view, and shows a state where the large-tank rear attaching portion of the storage tank is moved rearward after being engaged with the rear attachment-receiving portion of the tank mounting member from above and positioning is completed (a positioning completion state).

Figure 13C:
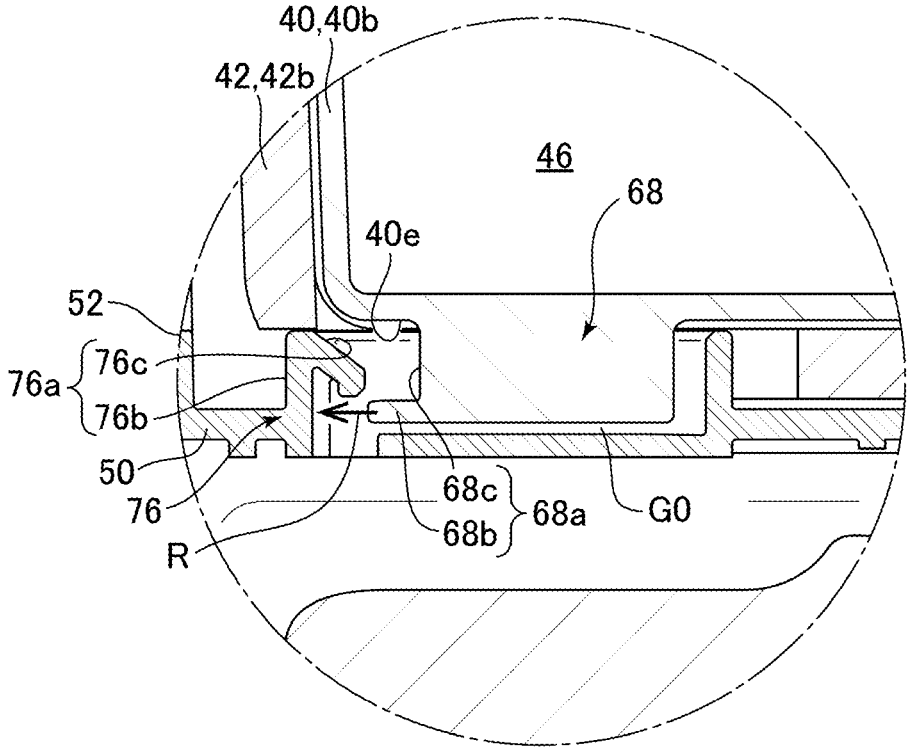
FIG. 13C is, like FIG. 13A, an enlarged partial cross-sectional view showing a part of the flush toilet according to the embodiment of the present invention in an enlarged manner, the part corresponding to a small-tank rear attaching portion of the storage tank and a rear attachment-receiving portion of the tank mounting member, FIG. 13C showing a state before the small-tank rear attaching portion of the storage tank is moved rearward after being engaged with the rear attachment-receiving portion of the tank mounting member from above (a pre-positioning state)

Next, FIG. 13C is, like FIG. 13A, an enlarged partial cross-sectional view showing a part of the flush toilet according to the embodiment of the present invention in an enlarged manner, the part corresponding to the small-tank rear attaching portion of the storage tank and the rear attachment-receiving portion of the tank mounting member, FIG. 13C showing a state before the small-tank rear attaching portion of the storage tank is moved rearward after being engaged with the rear attachment-receiving portion of the tank mounting member from above (a pre-positioning state).

Figure 13D:
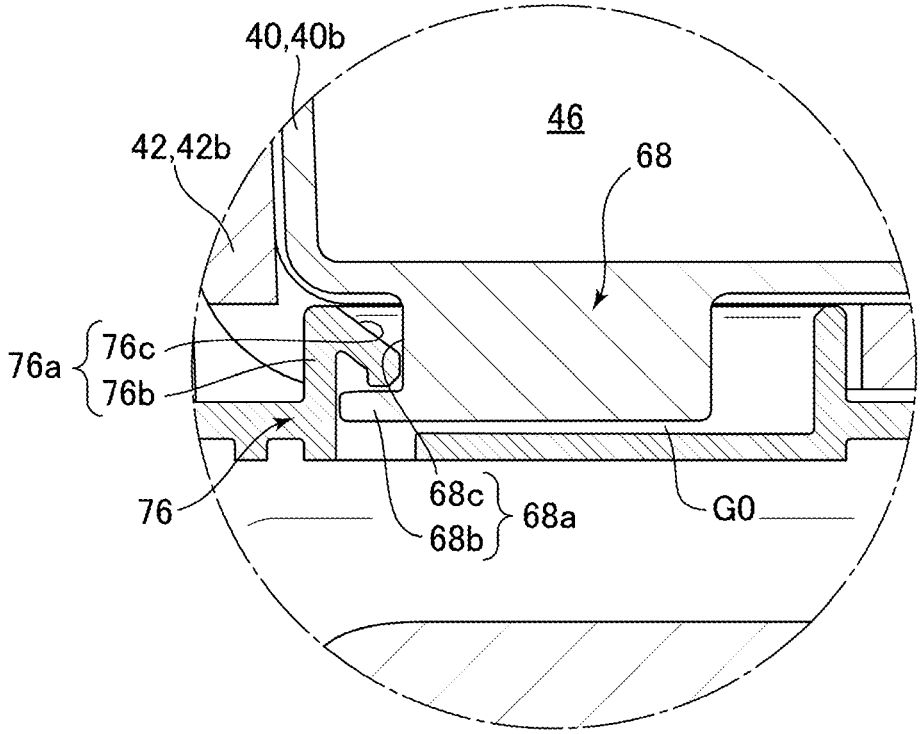
FIG. 13D is, like FIG. 13C, an enlarged partial cross-sectional view showing a part of the flush toilet according to the embodiment of the present invention in an enlarged manner, the part corresponding to the small-tank rear attaching portion of the storage tank and the rear attachment-receiving portion of the tank mounting member, FIG. 13D showing a state where the small-tank rear attaching portion of the storage tank is moved rearward after being engaged with the rear attachment-receiving portion of the tank mounting member from above and positioning is completed (a positioning completion state)

FIG. 13D is, like FIG. 13C, an enlarged partial cross-sectional view showing a part of the flush toilet according to the embodiment of the present invention in an enlarged manner, the part corresponding to the small-tank rear attaching portion of the storage tank and the rear attachment-receiving portion of the tank mounting member, FIG. 13D showing a state where the small-tank rear attaching portion of the storage tank is moved rearward after being engaged with the rear attachment-receiving portion of the tank mounting member from above and positioning is completed (a positioning completion state).

First, as shown in FIGS. 12, 13A, 13C and 14A, each rear attaching portion 66, 68 of the storage tank 10 protrudes downward from the bottom surface of the tank main body 40, and a lower end thereof is a foot portion that can come into contact with a bottom surface inside the corresponding rear attachment-receiving portion 74, 76 of the tank mounting member 48.

Furthermore, the antisweat material 42 is cut out around each rear attaching portion 66, 68 of the storage tank 10, and the lower end of each rear attaching portion 66, 68 (a bottom surface of the foot portion) is at a position that is slightly lower than the bottom surface 56*a*, 62*a* of the storage tank 10 (a bottom surface 42*c* of the antisweat material 42).

Furthermore, a locking portion (an attaching-side locking portion 66*a*, 68*a*) to be locked with the corresponding rear attachment-receiving portion 74, 76 of the tank mounting member 48 is provided at a lower end portion (the foot portion) of the corresponding rear attaching portion 66, 68.

As shown in FIGS. 13A to 13D, each rear attachment-receiving portion 74, 76 of the tank mounting member 48 is formed into a concave shape so as to be able to wholly receive the corresponding rear attaching portion 66, 68 of the storage tank 10 from above, and a locking portion (an attachment receiving-side locking portion 74*a*, 76*a*) that can be locked together with the corresponding attaching-side locking portion 66*a*, 68*a* of the rear attaching portion 66, 68 of the storage tank 10 is provided on a rear side of the rear attachment-receiving portion 74, 76.

Next, as shown in FIGS. 12, and 13A to 13D, each locking portion 66*a*, 68*a* of the storage tank 10 includes a locking projection 66*b*, 68*b* protruding rearward from a rear end of a bottom portion of the corresponding attaching portion 66, 68, and a locking concave portion 66*c*, 68*c* that is formed between the locking projection 66*b*, 68*b* and the bottom surface 40*e* of the tank main body 40 above.

Furthermore, as shown in FIGS. 13A to 13D, each locking portion 74*a*, 76*a* of the tank mounting member 48 includes a locking projection 74*b*, 76*b* that protrudes upward from near a rear end of the base plate 50.

As shown in FIG. 13A, when the storage tank 10 is attached from above to the tank mounting member 48 fixed behind the toilet main body 2, a bottom surface of the large-tank rear attaching portion 66 of the storage tank 10 is placed in a state where the bottom surface is in contact and engaged with the bottom surface of the rear attachment-receiving portion 74 of the tank mounting member 48 from above.

However, as shown in FIG. 13A, because the attaching-side locking portion 66*a* of the large-tank rear attaching portion 66 of the storage tank 10 and the corresponding attachment receiving-side locking portion 74*a* of the rear attachment-receiving portion 74 of the tank mounting member 48 are not locked with each other, the attaching-side locking portion 66*a* of the large-tank rear attaching portion 66 of the storage tank 10 is in a state where the attaching-side locking portion 66*a* is not positioned relative to the corresponding attachment receiving-side locking portion 74*a* of the rear attachment-receiving portion 74 of the tank mounting member 48 (a pre-positioning state).

Then, when the storage tank 10 is moved rearward relative to the tank mounting member 48, the large-tank rear attaching portion 66 of the storage tank 10 in the state shown in FIG. 13A is moved rearward (in an arrow R direction in FIG. 13A) relative to the rear attachment-receiving portion 74 of the tank mounting member 48.

Then, as shown in FIG. 13B, the attaching-side locking portion 66*a* of the large-tank rear attaching portion 66 of the storage tank 10 and the corresponding attachment receiving-side locking portion 74*a* of the rear attachment-receiving portion 74 of the tank mounting member 48 are locked with each other.

That is, as shown in FIG. 13B, a rear end portion of the locking projection 66*b* of the attaching-side locking portion 66*a* of the large-tank rear attaching portion 66 of the storage tank 10 abuts against a front surface of the locking projection 74*b* of the attachment receiving-side locking portion 74*a* of the rear attachment-receiving portion 74 of the tank mounting member 48.

At this time, the front end portion of the attachment receiving-side locking portion 74*a* of the rear attachment-receiving portion 74 of the tank mounting member 48 is fitted inside the locking concave portion 66*c* of the attaching-side locking portion 66*a* of the large-tank rear attaching portion 66 of the storage tank 10.

As a result, as shown in FIG. 13B, a state is reached where each attaching-side locking portion 66*a* of the large-tank rear attaching portion 66 of the storage tank 10 is positioned relative to the respective attachment receiving-side locking portion 74*a* of the rear attachment-receiving portion 74 of the tank mounting member 48 (a positioning completion state).

Next, as shown in FIG. 13C, when the storage tank 10 is attached from above to the tank mounting member 48 fixed behind the toilet main body 2, a bottom surface of the small-tank rear attaching portion 68 of the storage tank 10 is placed in a state where the bottom surface is not in contact with the bottom surface of rear attachment-receiving portion 76 of the tank mounting member 48 positioned below the aforementioned bottom surface and a gap G0 is formed.

However, as shown in FIG. 13C, because the attaching-side locking portion 68a of the small-tank rear attaching portion 68 of the storage tank 10 and the corresponding attachment receiving-side locking portion 76a of the rear attachment-receiving portion 76 of the tank mounting member 48 are not locked with each other, the attaching-side locking portion 68a of the small-tank rear attaching portion 68 of the storage tank 10 is in a state where the attaching-side locking portion 68a is not positioned relative to the corresponding attachment receiving-side locking portion 76a of the rear attachment-receiving portion 76 of the tank mounting member 48 (a pre-positioning state).

Then, when the storage tank 10 is moved rearward relative to the tank mounting member 48, the small-tank rear attaching portion 68 of the storage tank 10 in the state shown in FIG. 13C is moved rearward (in an arrow R direction in FIG. 13C) relative to the rear attachment-receiving portion 76 of the tank mounting member 48.

Then, as shown in FIG. 13D, the attaching-side locking portion 68a of the small-tank rear attaching portion 68 of the storage tank 10 and the corresponding attachment receiving-side locking portion 76a of the rear attachment-receiving portion 76 of the tank mounting member 48 are locked with each other.

That is, as shown in FIG. 13D, a rear end portion of the locking projection 68b of the attaching-side locking portion 68a of the small-tank rear attaching portion 68 of the storage tank 10 abuts against a front surface of the locking projection 76b of the attachment receiving-side locking portion 76a of the rear attachment-receiving portion 76 of the tank mounting member 48.

At this time, the front end portion of the attachment receiving-side locking portion 76a of the rear attachment-receiving portion 76 of the tank mounting member 48 is fitted inside the locking concave portion 68c of the attaching-side locking portion 68a of the small-tank rear attaching portion 68 of the storage tank 10.

As a result, as shown in FIG. 13D, a state is reached where each attaching-side locking portion 68a of the small-tank rear attaching portion 68 of the storage tank 10 is positioned relative to the respective attachment receiving-side locking portion 76a of the rear attachment-receiving portion 76 of the tank mounting member 48 (a positioning completion state).

At this time, a state is maintained where the bottom surface of the small-tank rear attaching portion 68 of the storage tank 10 is not in contact with the bottom surface of rear attachment-receiving portion 76 of the tank mounting member 48 positioned below the aforementioned bottom surface and the gap G0 is formed.

Furthermore, as shown in FIGS. 13A to 13D, the locking projections 74b, 76b of the locking portions 74a, 76a of the rear attachment-receiving portions 74, 76 of the tank mounting member 48 include, respectively, sloping surfaces 74c, 76c sloping obliquely downward to the front from upper ends of the locking projections 74b, 76b.

Accordingly, even if, at the time of attachment of the rear attaching portions 66, 68 of the storage tank 10 to the corresponding rear attachment-receiving portions 74, 76 of the tank mounting member 48 from above, the attaching-side locking portions 66a, 68a of the rear attaching portions 66, 68 of the storage tank 10 are placed on top of the sloping surfaces 74c, 76c or the upper ends of the locking projections 74b, 76b of the attachment-receiving portions 74, 76 of the tank mounting member 48 from above, the sloping surfaces 74c, 76c may function as guiding surfaces for guiding the corresponding locking portions 66a, 68a of the attaching portions 66, 68 of the storage tank 10 from the back to ranges inside the attachment-receiving portions 74, 76 of the tank mounting member 48 in front.

Figure 14A:
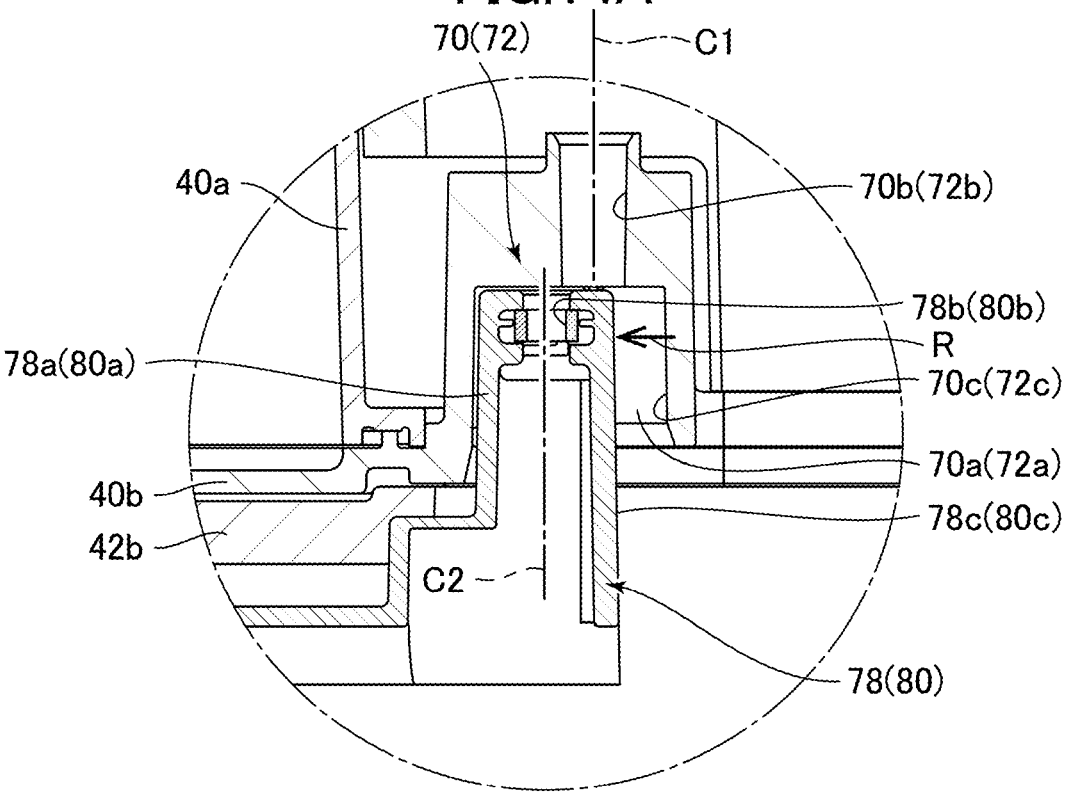
FIG. 14A is an enlarged partial cross-sectional view showing a part of the flush toilet according to the embodiment of the present invention shown in FIG. 11 in an enlarged manner, the part corresponding to a front attaching portion of the storage tank and a front attachment-receiving portion of the tank mounting member, FIG. 14A showing a state before the front attaching portion of the storage tank is moved rearward after being engaged with the front attachment-receiving portion of the tank mounting member from above (a pre-positioning state)

Next, FIG. 14A is an enlarged partial cross-sectional view showing a part of the flush toilet according to the embodiment of the present invention shown in FIG. 11 in an enlarged manner, the part corresponding to the front attaching portion of the storage tank and the front attachment-receiving portion of the tank mounting member, FIG. 14A showing a state before the front attaching portion of the storage tank is moved rearward after being engaged with the front attachment-receiving portion of the tank mounting member from above (a pre-positioning state).

Figure 14B:
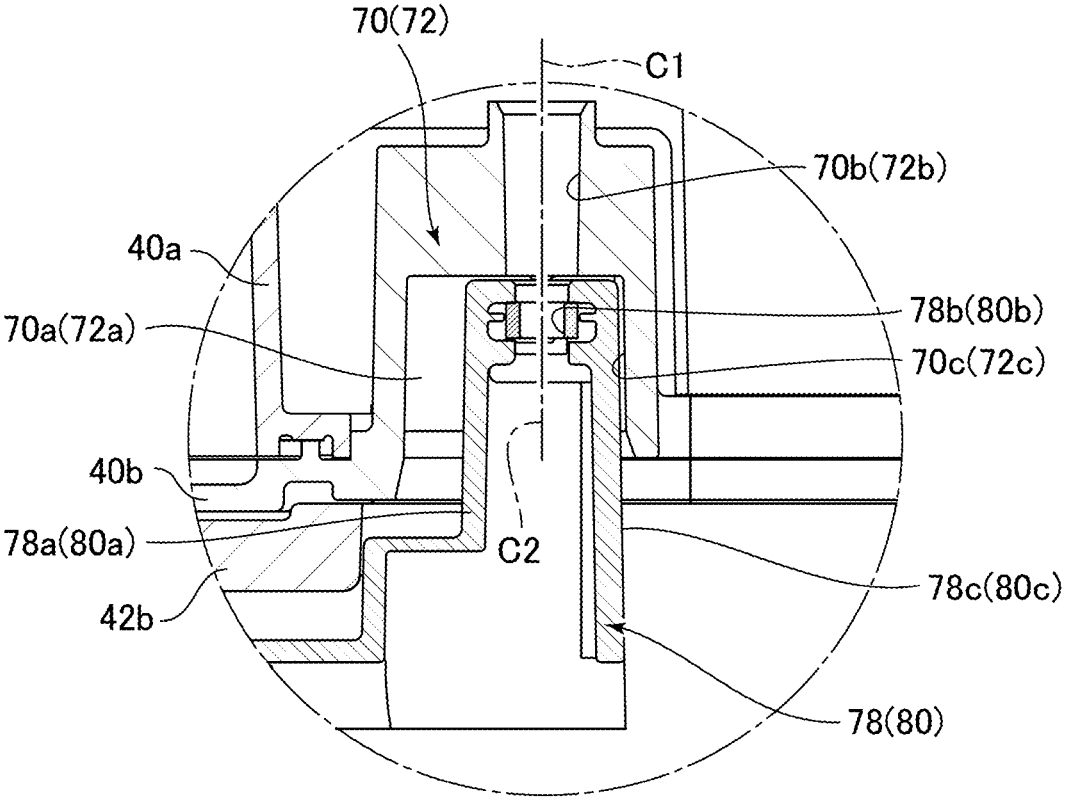
FIG. 14B is, like FIG. 14A, an enlarged partial cross-sectional view showing a part of the flush toilet according to the embodiment of the present invention in an enlarged manner, the part corresponding to the front attaching portion of the storage tank and the front attachment-receiving portion of the tank mounting member, FIG. 14B showing a state where the front attaching portion of the storage tank is moved rearward after being engaged with the front attachment-receiving portion of the tank mounting member from above and positioning is completed (a positioning completion state)

FIG. 14B is, like FIG. 14A, an enlarged partial cross-sectional view, and shows a state where the front attaching portion of the storage tank is moved rearward after being engaged with the front attachment-receiving portion of the tank mounting member from above and positioning is completed (a positioning completion state).

As shown in FIGS. 14A and 14B, each front attaching portion 70, 72 of the storage tank 10 and the corresponding front attachment-receiving portion 78, 80 of the tank mounting member 48 are screw-fixing portions that can be screw-fixed to each other (hereinafter referred to as "the screw-fixing portion(s) 70, 72 of the storage tank 10" and "the screw-fixing portion(s) 78, 80 of the tank mounting member 48").

Specifically, as shown in FIGS. 14A and 14B, the screw-fixing portions 78, 80 of the tank mounting member 48 include protruding portions 78a, 80a protruding upward from both left and right sides in a front region of the base plate 50, and screw holes (lower screw holes 78b, 80b) penetrating the protruding portions 78a, 80a in an up-down direction.

As shown in FIGS. 14A and 14B, fitting concave portions 70a, 72a where the protruding portions 78a, 80a of the screw-fixing portions 78, 80 of the tank mounting member 48 can be inserted from below are provided below the screw-fixing portions 70, 72 of the storage tank 10.

Furthermore, the fitting concave portions 70a, 72a of the storage tank 10 are formed larger than a dimension of the protruding portions 78a, 80a of the screw-fixing portions 78, 80 of the tank mounting member 48 in the front-back direction.

Accordingly, in a state where the fitting concave portions 70a, 72a of the storage tank 10 are fitted (engaged) with the corresponding protruding portions 78a, 80a of the screw-fixing portions 78, 80 of the tank mounting member 48, the screw-fixing portions 70, 72 of the storage tank 10 are capable of sliding in the front-back direction relative to the corresponding screw-fixing portions 78, 80 of the tank mounting member 48.

Furthermore, screw holes (upper screw holes 70b, 72b) penetrating in the up-down direction are formed above the corresponding fitting concave portions 70a, 72a of the screw-fixing portions 70, 72 of the storage tank 10.

As shown in FIG. 14A, in a state where the front attaching portions 70, 72 of the storage tank 10 are attached and engaged with the corresponding front attachment-receiving portions 78, 80 of the tank mounting member 48 from above but are not yet moved rearward (the pre-positioning state), front ends 70c, 72c of the fitting concave portions 70a, 72a of the screw-fixing portions 70, 72 of the storage tank 10 are separate from front ends 78*c*, 80*c* of the protruding portions 78*a*, 80*a* of the screw-fixing portions 78, 80 of the tank mounting member 48.

At this time, as shown in FIG. 14A, a central axis C1 of the upper screw holes 70*b*, 72*b* of the screw-fixing portions 70, 72 of the storage tank 10 is at a position more forward than a central axis C2 of the lower screw holes 78*b*, 80*b* of the screw-fixing portions 78, 80 of the tank mounting member 48, and the upper screw holes 70*b*, 72*b* do not coincide with the corresponding lower screw holes 78*b*, 80*b*.

Then, when the storage tank 10 is moved rearward relative to the tank mounting member 48, the screw-fixing portions 70, 72 of the storage tank 10 in the state shown in FIG. 14A move rearward (in the arrow R direction in FIG. 14A) relative to the corresponding rear attachment-receiving portions 74, 76 of the tank mounting member 48.

As shown in FIG. 14B, the front ends 70*c*, 72*c* of the fitting concave portions 70*a*, 72*a* of the screw-fixing portions 70, 72 of the storage tank 10 thus abut against the corresponding front ends 78*c*, 80*c* of the protruding portions 78*a*, 80*a* of the screw-fixing portions 78, 80 of the tank mounting member 48.

At this time, as shown in FIG. 14B, the central axis C1 of the upper screw holes 70*b*, 72*b* of the screw-fixing portions 70, 72 of the storage tank 10 coincides with the central axis C2 of the corresponding lower screw holes 78*b*, 80*b* of the screw-fixing portions 78, 80 of the tank mounting member 48, and positioning of the screw-fixing portions 70, 72 of the storage tank 10 and the screw-fixing portions 78, 80 of the tank mounting member 48 is completed.

Then, when common screw members 82 (see FIGS. 7 and 9) are fastened into the coinciding upper screw holes 70*b*, 72*b* and lower screw holes 78*b*, 80*b*, the screw-fixing portions 70, 72 of the storage tank 10 are fixed to the screw-fixing portions 78, 80 of the tank mounting member 48.

As a result, as shown in FIGS. 13A to 14B, when the attaching portions 66, 68, 70, 72 of the storage tank 10 and the corresponding attachment-receiving portions 74, 76, 78, 80 of the tank mounting member 48 are attached to each other, two positions are locked, that is, the attaching-side locking portions 66*a*, 68*a* of the rear attaching portions 66, 68 of the storage tank 10 and the corresponding attachment receiving-side locking portions 74*a*, 76*a* of the rear attachment-receiving portions 74, 76 of the tank mounting member 48 are locked, and attaching property of the storage tank 10 to the tank mounting member 48 is improved, and also, positioning of the front attaching portions (screw-fixing portions) 70, 72 of the storage tank 10 fixed by the screw members 82 relative to the corresponding front attaching portions (screw-fixing portions) 78, 80 of the tank mounting member 48 is facilitated.

Furthermore, in a state where the attaching portions 66, 68, 70, 72 of the storage tank 10 and the corresponding attachment-receiving portions 74, 76, 78, 80 of the tank mounting member 48 are attached to each other, the bottom surface of the large-tank rear attaching portion 66 of the storage tank 10 is in contact with the bottom surface of the rear attachment-receiving portion 74 of the tank mounting member 48 while a state is maintained in relation to the bottom surface of the small-tank rear attaching portion 68 of the storage tank 10, where the bottom surface is not in contact with the bottom surface of the rear attachment-receiving portion 76 of the tank mounting member 48 positioned below the aforementioned bottom surface and the gap G0 is formed.

Accordingly, compared with a structure where the bottom surface of the small-tank rear attaching portion 68 of the storage tank 10 is fixed by being in contact with the bottom surface of the rear attachment-receiving portion 76 of the tank mounting member 48 positioned below the aforementioned bottom surface, the storage tank 10 may be prevented from being fixed to the tank mounting member 48 in an excessively twisted state, and also, from a long-term perspective, strength of the storage tank 10 may be prevented from becoming low.

Furthermore, even if the storage tank 10 that is attached to the tank mounting member 48 tilts to the large tank section 44 side with a great capacity (the center of gravity tilts), because there is no gap between the bottom surface of the large-tank rear attaching portion 66 of the storage tank 10 and the bottom surface of the rear attachment-receiving portion 74 of the tank mounting member 48 (or the gap is smaller than on the small-tank rear attaching portion 68 side), the bottom surface of the large-tank rear attaching portion 66 of the storage tank 10 is landed on (or may swiftly land on) the bottom surface of the rear attachment-receiving portion 74 of the tank mounting member 48, so that the amount of deformation at the time of tilting of the storage tank 10 may be made small.

Figure 15:
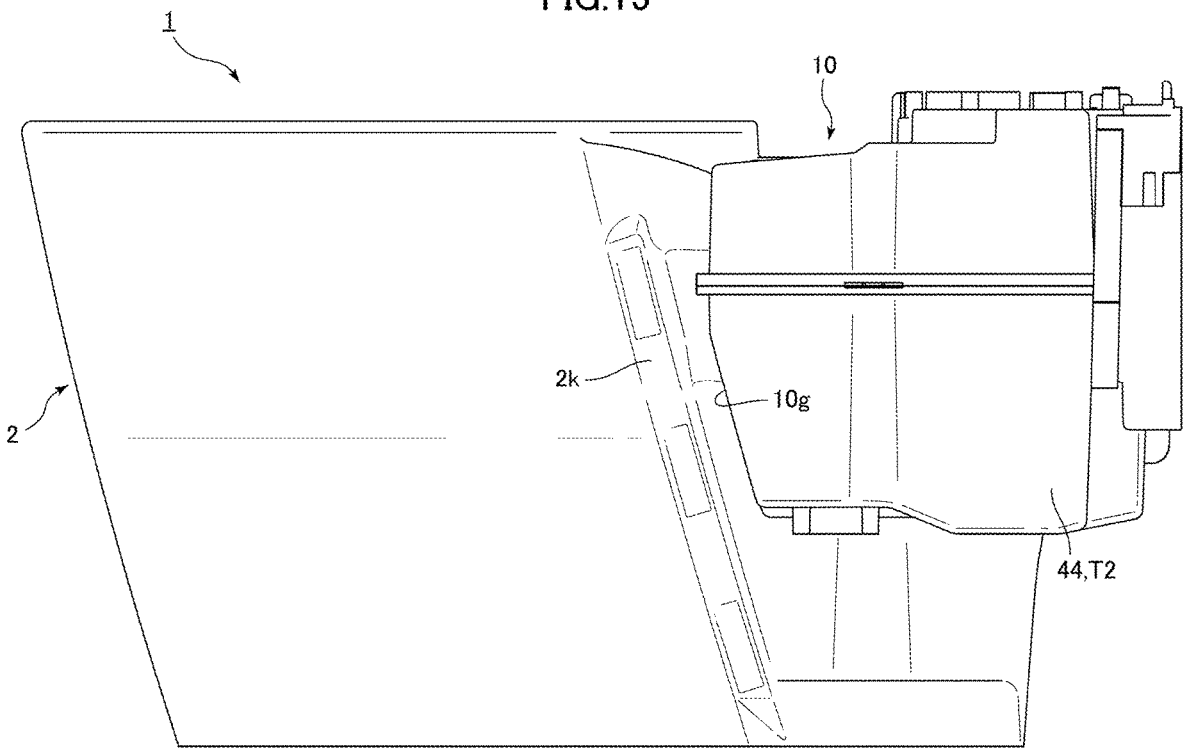
FIG. 15 is a side view of the toilet main body and the storage tank of the flush toilet according to the embodiment of the present invention.

Next, FIG. 15 is a side view of the toilet main body 2 and the storage tank 10 of the flush toilet 1 according to the embodiment of the present invention.

As shown in FIG. 15, a sloping surface 2*k* is formed on sides and a rear side of the toilet main body 2, the sloping surface 2*k* sloping obliquely downward to below the storage tank 10.

In a state where the storage tank 10 is fixed to the toilet main body 2, a front end portion (a front end surface 10*g*) of the large tank section 44 and the bottom tank member T2 of the storage tank 10 is disposed adjacent to the sloping surface 2*k* of the toilet main body 2 in a manner sloping along the sloping surface 2*k* of the toilet main body 2.

The front end surface 10*g* of the large tank section 44 and the bottom tank member T2 of the storage tank 10 and the sloping surface 2*k* on the sides and the rear side of the toilet main body 2 thus form surfaces that face each other in the front-back direction (see FIGS. 3 and 15).

Next, effects of the flush toilet 1 according to the embodiment of the present invention described above will be described with reference to FIGS. 1 to 15.

With the flush toilet 1 according to the present embodiment, when the storage tank 10 including the upper surfaces 44*b*, 46*b* with a height difference is tilted, because the capacity Va of the upper part Ta that is located at a position higher than the middle height position P0 that equally divides the storage tank 10 into two in the up-down direction is greater than the capacity Vb of the lower part Tb that is located at a position lower than the middle height position P0 of the storage tank 10, air tends to be trapped inside the upper part Ta of the storage tank 10.

However, with the flush toilet 1 of the present embodiment, even when air is trapped inside the storage tank 10 at the time of water supply from the water supply device (the water supply nozzle 6*a*) to the storage tank 10 via the water receiving housing 24, the water passage port 10*a* (see FIG. 5) provided in the highest surface A2 of the upper surface 44*b* of the large tank section 44 of the storage tank 10 may function as an air vent that facilitates escape of air that is trapped beforehand.

Accordingly, even when the capacity Va of the upper part Ta that is located at a position higher than the middle height position P0 that equally divides the storage tank 10 into two in the up-down direction is greater than the capacity Vb of the lower part Tb that is located at a position lower than the middle height position P0 of the storage tank 10, the amount of flush water W1 (see FIG. 4) that is supplied from the water supply device (the water supply nozzle 6*a*) via the water receiving housing 24 and stored in the storage tank 10 may be prevented from being reduced or varied due to the trapped air in the storage tank 10. A greater amount of flush water may thus be stored in the storage tank 10.

Furthermore, when the flush water W1 is supplied from the water supply device (the water supply nozzle 6*a*) to the storage tank 10 via the water receiving housing 24 and the water level inside the storage tank 10 rises, because air trapped in the storage tank 10 can easily escape from the water passage port 10*a* beforehand, occurrence of abnormal noise due to trapped air (for example, abnormal noise that is generated at the time of trapped air in the storage tank 10 being captured in the water being supplied, abnormal noise that is generated at the time of trapped air escaping from the water passage port 10*a* (deaeration sound), and the like) may be prevented.

Furthermore, with the flush toilet 1 according to the present embodiment, the upper surface 44*b* of the storage tank 10 is formed such that the upper surface 44*b* becomes lower from the surface (the highest surface A2) where the water passage port 10*a* is formed toward the surface A3 on the outer periphery in a continuous and stepwise manner.

Accordingly, even if the storage tank 10 is tilted, air inside the storage tank 10 may be guided to the water passage port 10*a* of the storage tank 10 along the upper surface 44*b* of the storage tank 10 that becomes lower in a continuous and stepwise manner.

Accordingly, air entrapment in the storage tank 10 may be reliably prevented.

Furthermore, with the flush toilet 1 according to the present embodiment, because the toilet main body 2 is made of ceramics, a dimensional error easily occurs at the time of manufacture. Furthermore, the greater the dimensional error of the toilet main body 2, the greater the possibility of the storage tank 10 being greatly tilted when the storage tank 10 is disposed on the toilet main body 2.

However, with the flush toilet 1 according to the present embodiment, because the storage tank 10 may be securely and stably fixed to the toilet main body 2 by the fixing portions (the attaching portions M1) of the storage tank 10, wobbling of the storage tank 10 may be prevented.

Furthermore, even when the toilet main body 2 is made of ceramics, occurrence of air entrapment due to wobbling of the storage tank 10 may be prevented, and a greater amount of flush water may be stored in the storage tank 10.

Furthermore, with the flush toilet 1 according to the present embodiment, the fixing portions (the attaching portions M1) of the storage tank 10 to be fixed to the toilet main body 2 are provided at least on the bottom tank member T2 among the top tank member T1 and the bottom tank member T2 that are joined to each other in the up-down direction, in such a manner that the number of fixing portions is greater for the bottom tank member T2 than for the top tank member T1.

Accordingly, the fixing portions (the attaching portions M1) of the storage tank 10 may be concentrated on the bottom tank member T2 side as much as possible. An assembly error and the like may thus be reduced at the time of assembling the storage tank 10 with the toilet main body 2 and fixing the storage tank 10 to the toilet main body 2 by fixing the fixing portions (the attaching portions M1) of the storage tank 10 to the attachment-receiving portions M2 of the tank mounting member 48.

Accordingly, because tilting of the storage tank 10 may be prevented, occurrence of air entrapment due to tilting of the storage tank 10 may be prevented.

Moreover, weight of the flush water in the storage tank 10 is mainly supported from below by the bottom tank member T2.

Accordingly, because the storage tank 10 may be more stably fixed to the toilet main body 2 when a greater number of fixing portions (attaching portions M1) of the storage tank 10 is provided on the bottom tank member T2 than on the top tank member T1, tilting of the storage tank 10 may be more reduced.

Furthermore, compared with a case where a greater number of fixing portions (attaching portions M1) of the storage tank 10 is provided on the top tank member T1 than on the bottom tank member T2, it is possible to reduce the risk of occurrence of air entrapment in the storage tank 10 due to warping or the like of the upper surfaces 44*b*, 46*b* of the storage tank 10 caused by deformation of the top tank member T1 under a fixing load and the like applied to the fixing portions (the attaching portions M1).

Moreover, when a greater number of fixing portions (attaching portions M1) of the storage tank 10 is provided on the bottom tank member T2 than on the top tank member T1, an upper space and the like of the top tank member T1 required for the fixing portions (the attaching portions M1) of the storage tank 10 may be reduced. This enables the height of an upper end position of the storage tank 10 to be set as low as possible, and a low silhouette may be achieved for the entire flush toilet 1.

Furthermore, as shown in FIG. 15, with the flush toilet 1 according to the present embodiment, a surface, of the toilet main body 2, facing the large tank section 44 of the storage tank 10 in the front-back direction forms the sloping surface 2*k* that slopes obliquely downward to below the storage tank 10.

Furthermore, the front end portion (the front end surface 10*g*) of the large tank section 44 of the storage tank 10 is disposed adjacent to the sloping surface 2*k* of the toilet main body 2 in a manner sloping along the sloping surface 2*k* of the toilet main body 2.

Accordingly, for example, even if the storage tank 10 is tilted due to occurrence of a trouble such as the fixing portion (the attaching portion M1) of the storage tank 10 being damaged, the front end portion (the front end surface 10*g*) of the storage tank 10 may abut against the sloping surface 2*k* of the toilet main body 2 that is adjacent and facing the front end portion.

The storage tank 10 may thus be prevented from being greatly tilted, and occurrence of air entrapment due to tilting of the storage tank 10 may be reliably prevented.

What is claimed is:

1. A flush toilet comprising:

a toilet main body including a bowl configured to receive waste, and a discharge trap configured to discharge the waste in the bowl; and a tank device configured to supply the flush water to the toilet main body, wherein the tank device includes:

a storage tank configured to store the flush water to be supplied to the toilet main body, the storage tank being provided behind the toilet main body and above a floor surface, a water supply device configured to supply the flush water to the storage tank, and a pump configured to pressurize and feed the flush water in the storage tank to the toilet main body, wherein the storage tank includes an upper part and a lower part, and the upper part is located at a position higher than a middle height position that equally divides the storage tank into two in an up-down direction, and the lower part is located at a position lower than the middle height position, and a capacity of the upper part is greater than a capacity of the lower part, and the storage tank includes a plurality of upper surfaces with height differences, and a water passage port is provided to penetrate a highest surface among the upper surfaces to allow the flush water that is supplied from the water supply device to flow into the storage tank, the water passage port being always open, and the highest surface being positioned on one of left and right sides relative to a vertical plane that divides the storage tank into two at a center in a left-right direction.

2. The flush toilet according to claim 1, wherein the upper surface of the storage tank is formed such that the upper surface becomes lower from a surface where the water passage port is formed toward an outer periphery in a continuous or stepwise manner.

3. The flush toilet according to claim 1, wherein the toilet main body is made of ceramics, and the storage tank includes fixing portions that are fixable to the toilet main body.

4. The flush toilet according to claim 3, wherein the storage tank includes a top tank section and a bottom tank section that are joined to each other in the up-down direction, and the fixing portions are provided at least on the bottom tank section among the top tank section and the bottom tank section, with the number of the fixing portions being greater for the bottom tank section than for the top tank section.

5. The flush toilet according to claim 3, wherein the storage tank has a left-right asymmetrical shape including a large tank section and a small tank section, the large tank section being a large-capacity side of the storage tank that is divided into two at a center in a left-right direction, the small tank section being a small-capacity side of the storage tank that is divided into two at the center in the left-right direction, a surface of the toilet main body facing the large tank section in a front-back direction forms a sloping surface that slopes obliquely downward to below the storage tank, and in a state where the fixing portions of the storage tank are fixed to the toilet main body, a front end portion of the large tank section is disposed adjacent to the sloping surface of the toilet main body in a manner sloping along the sloping surface of the toilet main body.

6. A flush toilet comprising:

a toilet main body including a bowl configured to receive waste, and a discharge trap configured to discharge the waste in the bowl; and a tank device configured to supply the flush water to the toilet main body, wherein the tank device includes:

a storage tank configured to store the flush water to be supplied to the toilet main body, the storage tank being provided behind the toilet main body and above a floor surface, a water supply device configured to supply the flush water to the storage tank, and a pump configured to pressurize and feed the flush water in the storage tank to the toilet main body, wherein the storage tank includes an upper part and a lower part, and the upper part is located at a position higher than a middle height position that equally divides the storage tank into two in an up-down direction, and the lower part is located at a position lower than the middle height position, and a capacity of the upper part is greater than a capacity of the lower part, and the storage tank includes a plurality of upper surfaces with height differences, and a water passage port is provided to penetrate a highest surface among the upper surfaces to allow the flush water that is supplied from the water supply device to flow into the storage tank, wherein the toilet main body is made of ceramics, and the storage tank includes fixing portions that are fixable to the toilet main body, wherein the storage tank includes a top tank section and a bottom tank section that are joined to each other in the up-down direction, and the fixing portions are provided at least on the bottom tank section among the top tank section and the bottom tank section, with the number of the fixing portions being greater for the bottom tank section than for the top tank section.

* * * * *